US008951093B2

(12) United States Patent
Sofman et al.

(10) Patent No.: US 8,951,093 B2
(45) **Date of Patent: *Feb. 10, 2015**

(54) DISTRIBUTED SYSTEM OF AUTONOMOUSLY CONTROLLED MOBILE AGENTS

(71) Applicant: Anki, Inc., San Francisco, CA (US)

(72) Inventors: Boris Sofman, San Francisco, CA (US); Hanns W. Tappeiner, San Francisco, CA (US); Mark Palatucci, San Francisco, CA (US)

(73) Assignee: Anki, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/265,093

(22) Filed: Apr. 29, 2014

(65) Prior Publication Data

US 2014/0235138 A1 Aug. 21, 2014

Related U.S. Application Data

(63) Continuation of application No. 13/707,512, filed on Dec. 6, 2012, now Pat. No. 8,747,182, which is a continuation of application No. 12/788,605, filed on May 27, 2010, now Pat. No. 8,353,737.

(60) Provisional application No. 61/181,719, filed on May 28, 2009, provisional application No. 61/261,023, filed on Nov. 13, 2009.

(51) Int. Cl.
*A63H 30/04* (2006.01)
*A63H 17/26* (2006.01)
(Continued)

(52) U.S. Cl.
CPC ..... *A63H 17/26* (2013.01); *A63H 17/40* (2013.01); *A63H 18/16* (2013.01); *A63H 30/04* (2013.01); *A63H 17/32* (2013.01); *A63H 17/44* (2013.01)
USPC ..... 446/456; 446/454; 446/410

(58) Field of Classification Search
USPC ..... 446/456
See application file for complete search history.

(56) References Cited

U.S. PATENT DOCUMENTS 4,307,791 A 12/1981 De Bruine
4,658,928 A 4/1987 Seo
(Continued)

FOREIGN PATENT DOCUMENTS

DE 19532540 3/1997
DE 202004018425 4/2006
(Continued)

OTHER PUBLICATIONS

Zlot, Robert et al., "Multi-Robot Exploration Controlled by a Market Economy", 2009 IEEE, 9 pages.

*Primary Examiner* — Tramar Harper
(74) *Attorney, Agent, or Firm* — Raubvogel Law Office

(57) ABSTRACT

A system includes a drivable surface that includes location encoding markings. A mobile agent is provided that includes a drive motor, an imaging system for taking images of the markings, a vehicle wireless transceiver, and a microcontroller operatively coupled to the motor, the imaging system, and the vehicle wireless transceiver. A basestation is provided that includes a controller operatively coupled to a basestation wireless transceiver. Via wireless communication between the wireless transceivers of the mobile agent and the basestation, an action to be implemented by the mobile agent can be determined by the basestation and communicated to the mobile agent, whereupon the microcontroller of the mobile agent controls detailed movement of the mobile agent on the drivable surface based on images taken of the markings of the drivable surface by the imaging system to cause the mobile agent to implement the action on the drivable surface.

29 Claims, 32 Drawing Sheets

(51) Int. Cl.

| | |
|---|---|
| ***A63H 17/40*** | (2006.01) |
| ***A63H 18/16*** | (2006.01) |
| ***A63H 17/32*** | (2006.01) |
| ***A63H 17/44*** | (2006.01) |

(56) References Cited

U.S. PATENT DOCUMENTS

| | | | |
|---|---|---|---|
| 5,203,733 | A | 4/1993 | Patch et al. |
| 5,452,901 | A | 9/1995 | Nakada et al. |
| 5,697,829 | A | 12/1997 | Chainani et al. |
| 6,012,957 | A | 1/2000 | Cyrus et al. |
| 6,254,478 | B1 | 7/2001 | Namanny et al. |
| 6,491,566 | B2 | 12/2002 | Peters et al. |
| 6,783,425 | B2 | 8/2004 | McKeefery |
| 7,097,532 | B1 | 8/2006 | Rolicki et al. |
| 7,753,756 | B2 | 7/2010 | McDermott et al. |
| 8,160,994 | B2 | 4/2012 | Ong et al. |
| 8,287,372 | B2 | 10/2012 | Hong et al. |
| 2002/0102910 | A1 | 8/2002 | Donahue et al. |
| 2003/0060287 | A1 | 3/2003 | Nishiyama |
| 2003/0232649 | A1 | 12/2003 | Gizis et al. |
| 2004/0266506 | A1 | 12/2004 | Herbrich et al. |
| 2005/0186884 | A1 | 8/2005 | Evans |
| 2006/0073760 | A1 | 4/2006 | Tremel et al. |
| 2006/0073761 | A1 | 4/2006 | Weiss et al. |
| 2006/0223637 | A1 | 10/2006 | Rosenberg et al. |
| 2007/0017984 | A1 | 1/2007 | Mountz et al. |
| 2007/0021863 | A1 | 1/2007 | Mountz et al. |
| 2007/0021864 | A1 | 1/2007 | Mountz et al. |
| 2007/0173171 | A1 | 7/2007 | Benedek et al. |
| 2007/0173177 | A1 | 7/2007 | Hirokawa et al. |
| 2007/0293124 | A1 | 12/2007 | Smith et al. |
| 2008/0026671 | A1 | 1/2008 | Smith et al. |
| 2009/0004948 | A1 | 1/2009 | Ando et al. |
| 2009/0111356 | A1 | 4/2009 | Haass et al. |
| 2009/0284553 | A1 | 11/2009 | Seydoux |
| 2010/0093255 | A1 | 4/2010 | Yamamoto |
| 2010/0099493 | A1 | 4/2010 | Horovitz |
| 2010/0178966 | A1 | 7/2010 | Seydoux |
| 2010/0203933 | A1 | 8/2010 | Eyzaguirre et al. |
| 2010/0230198 | A1 | 9/2010 | Frank et al. |
| 2010/0304640 | A1 | 12/2010 | Sofman et al. |

FOREIGN PATENT DOCUMENTS

| | | |
|---|---|---|
| JP | 7016348 | 1/1995 |
| JP | 2001022264 | 1/2001 |
| JP | 2003346240 | 12/2002 |
| JP | 2005185655 | 7/2005 |
| KR | 100842566 | 7/2008 |
| WO | 2009037677 | 3/2009 |

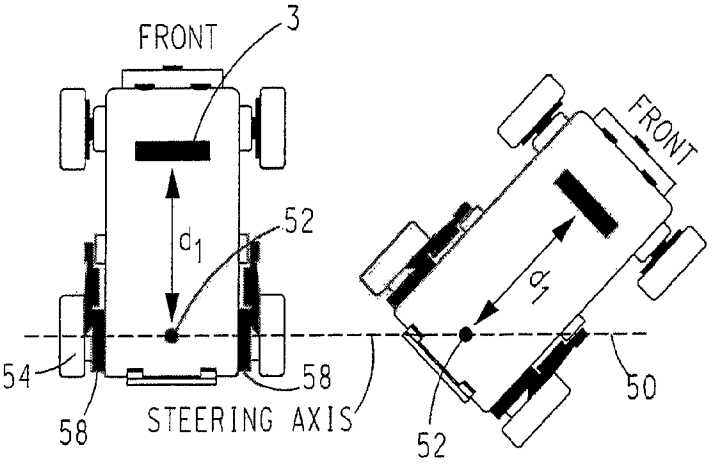
FIG. 13A
FIG. 13B
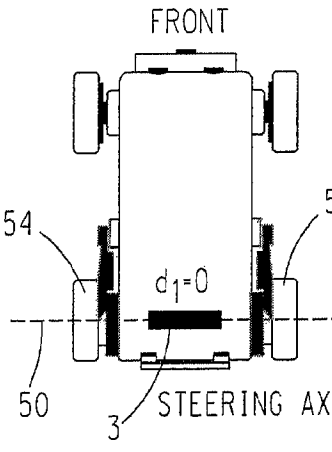
FIG. 13C
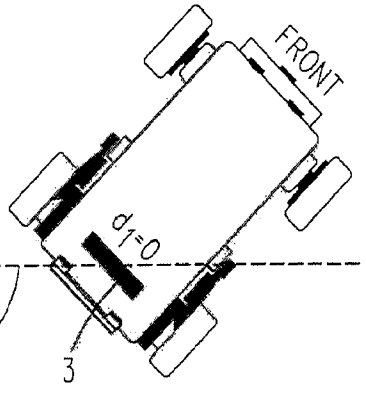
FIG. 13D

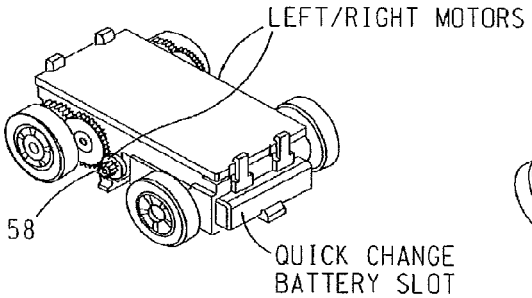
FIG. 14A
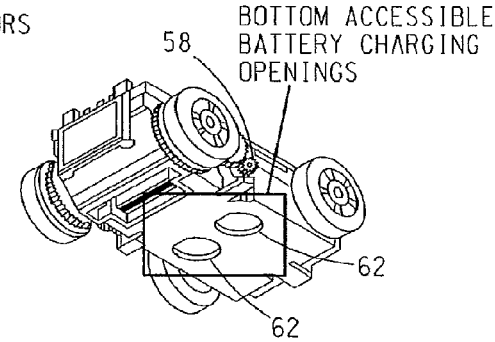
FIG. 14B
FIG. 15A
FIG. 15B
FIG. 15C
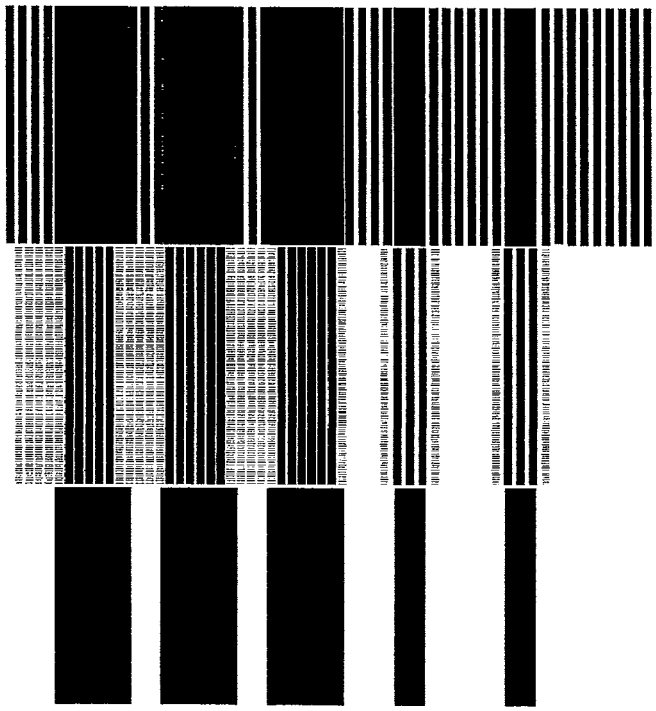

DESIRED: STRAIGHT
BIAS: APPROX. STRAIGHT

DESIRED: LEFT CURVE
BIAS: APPROX. STRAIGHT

DESIRED: LEFT CURVE N
BIAS: LEFT CURVE M

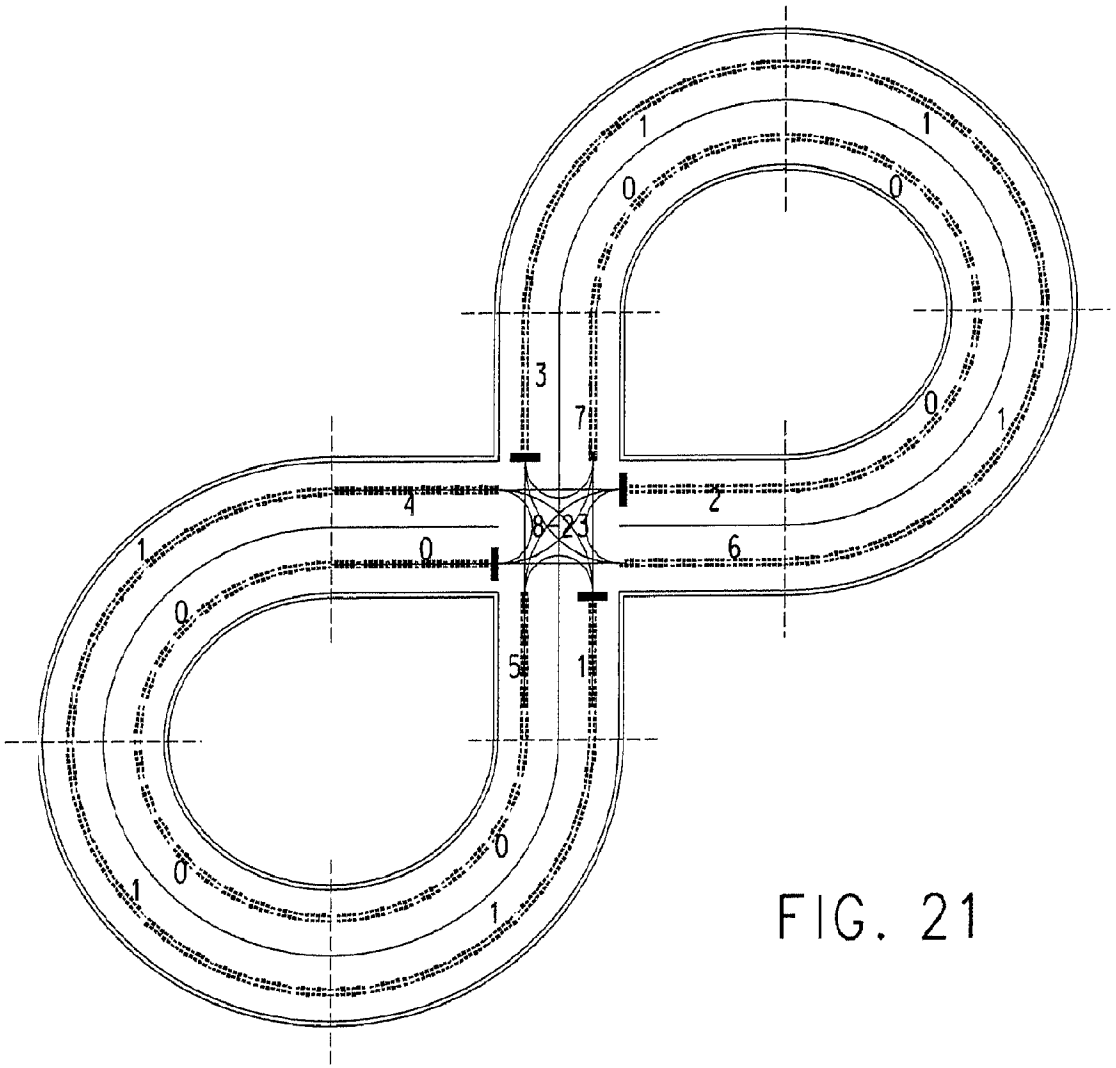
1
0
1
0
1
0

DISTRIBUTED SYSTEM OF AUTONOMOUSLY CONTROLLED MOBILE AGENTS

CROSS-REFERENCE TO RELATED APPLICATIONS

This application claims priority from U.S. Utility application Ser. No. 13/707,512, for "Distributed System of Autonomously Controlled Toy Vehicles", filed on Dec. 6, 2012, which is incorporated herein by reference. U.S. Utility application Ser. No. 13/707,512 claimed priority from U.S. Utility application Ser. No. 12/788,605, for "Distributed System of Autonomously Controlled Toy Vehicles", filed on May 27, 2010 and issued as U.S. Pat. No. 8,353,737 on Jan. 15, 2013, which is incorporated herein by reference. U.S. Utility application Ser. No. 12/788,605 claimed priority from U.S. Provisional Patent Application No. 61/181,719, filed on May 28, 2009, and 61/261,023, filed on Nov. 13, 2009, both of which are incorporated herein by reference.

BACKGROUND OF THE INVENTION

1. Field of the Invention

The invention is in the technical field of electronic toys. More specifically, the invention pertains to mobile toys such as electronic cars and model railroads.

2. Description of Related Art

Many electronic toys are controlled by a human operator. Such examples include radio and remote controlled cars and model trains that are controlled through a handheld device.

These kinds of toys have little or no ability to sense and interact intelligently and flexibly with their environment. Also, they do not have the ability to adjust their behavior in response to the actions of other toys. Further, many toys are physically constrained to slot or track systems and are therefore restricted in their motion.

SUMMARY OF THE INVENTION

The invention is a toy system that includes a drivable surface comprised of a plurality of segments, e.g., without limitation, a straight segment, an intersection segment, a left-curve segment, a right-curve segment, a left-turn segment, a right-turn segment, and/or any other suitable and/or desirable segment that can be envisioned. Each segment includes markings which encode locations on the segment and which encode a location of the segment on the drivable surface. The toy system also includes at least one toy vehicle (or mobile agent). The toy vehicle (or mobile agent) can take on any suitable and/or desirable form, such as, without limitation, a vehicle (e.g., a car, a truck, an ambulance, etc), an animal, or any other desired form. The toy vehicle includes at least one motor for imparting motive force to the toy vehicle, an imaging system operative for taking images of the markings, a vehicle wireless transceiver, and a microcontroller operatively coupled to the motor, the imaging system, and the vehicle wireless transceiver. The microcontroller is operative for controlling, via the motor of the toy vehicle, detailed movement of the toy vehicle on the drivable surface based on images taken of the markings of the drivable surface by the imaging system. Lastly, the toy vehicle includes a basestation comprising a controller and a basestation wireless transceiver operatively coupled to the controller. The controller is operative for determining via wireless communication from each vehicle wireless transceiver to the basestation wireless transceiver a current location of the toy vehicle on the drivable surface based on images taken of the markings of the drivable surface by the imaging system of the toy vehicle. The controller stores a virtual representation of the drivable surface and determines based on said virtual representation and the current location of each toy vehicle on the drivable surface an action to be taken by the toy vehicle on the drivable surface, such as, without limitation: vehicle speed, vehicle acceleration, vehicle direction/heading, the state of at least one light of the vehicle, and/or a sound output by an audio speaker of the vehicle. Lastly, the controller communicates to the microcontroller of each toy vehicle the action to be taken by the toy vehicle on the drivable surface via wireless communication from the basestation wireless transceiver to the vehicle wireless transceiver.

The microcontroller of each toy vehicle can be responsive to the action communicated by the controller for controlling the detailed movement of the toy vehicle on the drivable surface based on images taken of the markings of the drivable surface by the imaging system to cause the toy vehicle to move toward a future location on the drivable surface. The detailed movement of the toy vehicle comprises the microcontroller's detailed implementation of the action communicated by the controller, which action comprises one or more acts to be performed by the toy vehicle to move to the future location. More specifically, the future location resides in the controller as a static or dynamic location where the controller desires the toy vehicle to move. The action communicated by the controller to the microprocessor comprises one or more actions to be performed by the toy vehicle in furtherance of the overall goal or plan of movement of the toy vehicle to the future location. Lastly, the detailed movement of the toy vehicle comprises, for each action to be performed by the toy vehicle, one or more steps to be taken by the toy vehicle in furtherance of the action.

As can be seen, the future location, the one or more actions to be performed by the toy vehicle, and the detailed movement/steps to be taken by the toy vehicle represent a distributed command hierarchy, with the future location stored at the controller being at the top of the hierarchy, the one or more actions to be performed communicated by the controller to the microprocessor in the middle of the hierarchy, and the detailed movement/steps to be taken by the toy vehicle being at the bottom of the hierarchy. Each successively lower level of this distributed control hierarchy comprises increasingly more detailed instructions/commands in furtherance of a higher level command. For example, without limitation, the microcontroller may need to implement a number of steps in fulfillment of an action (e.g., change lanes to the left) communicated to the microcontroller by the basestation. Similarly, the basestation may need to implement a number of actions in fulfillment of the overall goal or plan of movement of the toy vehicle to the future location.

The toy system can also include a plurality of toy vehicles. The controller can be operative for controlling the interaction of the plurality of toy vehicles on the drivable surface in a coordinated manner with each other via wireless communication from the basestation wireless transceiver to the vehicle wireless transceivers of the plurality of toy vehicles.

The controller can be operative for controlling at least one of the following of at least one of the plurality of toy vehicles: a velocity or acceleration of the toy vehicle; a set, e.g., row, of markings (driving lane) the toy vehicle follows on the drivable surface; a changing of the toy vehicle from one set of markings (driving lane) on the drivable surface to another set of markings (driving lane) on the drivable surface; a direction the toy vehicle takes at an intersection of the drivable surface; the toy vehicle leading, following, or passing another toy vehicle on the drivable surface; or activation or deactivation of a light, an audio speaker, or both of a toy vehicle. The controller can also be operative for updating control software (e.g., without limitation, firmware) of the vehicle that controls the operation of the vehicle microprocessor.

The toy system can also include a remote control in communication with the basestation, wherein the basestation is responsive to commands issued by the remote control for controlling at least one of the following via the basestation: which one of a plurality of toy vehicles is responsive to the commands issued by the remote control; a velocity or acceleration of a toy vehicle responsive to commands issued by the remote control; a changing of a toy vehicle responsive to commands issued by the remote control from one set of markings (driving lane) on the drivable surface to another set of markings (driving lane) on the drivable surface; a direction a toy vehicle responsive to commands issued by the remote control takes at an intersection of the drivable surface; a toy vehicle responsive to commands issued by the remote control leading, following, or passing another toy vehicle on the drivable surface; or activation or deactivation of a light, an audio speaker, or both of a toy vehicle responsive to commands issued by the remote control.

The controller can be operative for controlling, either in response to or in the absence of a response to movement of a remote controlled vehicle, at least one of the following of each toy vehicle not under the control of the remote control: a velocity or acceleration of the toy vehicle; a set of markings (driving lane) the toy vehicle follows on the drivable surface; a changing of the toy vehicle from one set of markings (driving lane) on the drivable surface to another set of markings (driving lane) on the drivable surface; a direction the toy vehicle takes at an intersection of the drivable surface; the toy vehicle leading, following, or passing another toy vehicle on the drivable surface; or activation or deactivation of a light, an audio speaker, or both of a toy vehicle.

The drivable surface can include at least one multi-state device (e.g., a traffic light. a railroad crossing gate, a draw bridge, a trap on a road piece, a garage door, etc.) responsive to the controller for changing from a one state to another state.

The imaging system can include a light source outputting light toward the markings and an imaging sensor for detecting light from the light source reflected from the markings.

A layer can cover the markings of at least one segment. The layer can be transparent to light output by the vehicle's imaging system but opaque at human visible light wavelengths. The markings can be visible or invisible at frequencies detectable by humans.

The controller can be responsive to the current location of the toy vehicle on the drivable surface and the virtual representation of the drivable surface for causing a display to display the following: a virtual image of the drivable surface and a virtual image of at least one toy vehicle and its position, velocity, or both on the virtual image of the drivable surface.

The drivable surface can be comprised of a plurality of discrete segments operatively coupled together.

The invention is also a method of controlling movement of one or more self-propelled toy vehicles (or mobile agents) on a drivable surface that includes markings which define one or more paths of toy vehicle travel on the drivable surface and which encode locations on the drivable surface, wherein each toy vehicle includes an imaging system for acquiring images of the markings. Each toy vehicle (or mobile agent) can take on any suitable and/or desirable form, such as, without limitation, a vehicle (e.g., a car, a truck, an ambulance, etc) an animal, or any other desired form. The method comprises (a) while traveling on the drivable surface, a toy vehicle acquiring an image of a portion of the markings of the drivable surface via the toy vehicle's imaging system; (b) responsive to the image acquired in step (a), the toy vehicle controlling its movement on the drivable surface; (c) the toy vehicle wirelessly communicating to a basestation data regarding a location on the drivable surface where the portion of the markings in step (a) were acquired; (d) the basestation responsive to the data communicated in step (c) for updating a position of the toy vehicle in a virtual representation of the drivable surface; (e) the basestation determining an action to be taken by the toy vehicle on the drivable surface based on the data regarding the location on the drivable surface of the portion of the markings acquired in step (a); and (f) the basestation wirelessly communicating to the toy vehicle said action to be taken by the toy vehicle on the drivable surface.

The method can also include repeating step (a)-(f) at least one time. Step (b) can include the toy vehicle being responsive to the action communicated in step (f) for controlling its movement on the drivable surface.

Step (b) can include the action communicated in step (f) causing the toy vehicle to change from traveling on a first path defined by a first set of markings to a second travel path defined by a second set of markings, whereupon the action communicated in step (f) includes said second travel path.

Step (b) can also include the toy vehicle controlling its velocity, its acceleration, its steering direction, a state of one or more of its lights, whether a vehicle audio replication device outputs sound.

The method can also include the basestation determining the virtual representation of the drivable surface from one of the following: a definition file accessible to the basestation; exploration of the physical layout of the drivable surface by one or more toy vehicles acting under the control of the basestation and communicating information regarding the physical layout of the drivable surface to the basestation; or a bus system of the drivable surface which is comprised of a plurality of segments, wherein each segment includes a bus segment and a microcontroller that communicates with the basestation and with the microcontroller of each adjacent connected segment via the bus segment.

Step (a) can include acquiring the image of the markings via an overlayer that is transparent to the toy vehicle's imaging system but which is opaque at human visible light wavelengths.

The method can include repeating steps (a)-(f) for each of a plurality of toy vehicles, wherein: step (e) can also include the basestation determining for each toy vehicle a unique action to be taken by the toy vehicle; and step (f) can also include the basestation wirelessly communicating to each toy vehicle the unique action to be taken by said toy vehicle on the drivable surface in a manner whereupon the plurality of toy vehicles move in a coordinated manner on the road.

The method can also include the basestation receiving a command for the toy vehicle from a remote control, wherein step (e) can also include the basestation determining the action to be taken by the toy vehicle on the drivable surface based on the command received from the remote control.

BRIEF DESCRIPTION OF THE DRAWINGS

FIGS. 13A and 13B show the position change of the imaging system when the vehicle has a steering axis that is displaced by a distance $d_1$ from the imaging system;

FIGS. 13C and 13D show how the position of the imaging system changes when $d_1$ is equal to 0;

FIGS. 14A and 14B are top and bottom perspective views of a vehicle showing the location of a battery slot and charging openings, respectively, for charging a battery of the vehicle utilized to supply power to the microcontroller, the wireless radio network, the motor drive unit, the imaging system, and the secondary input/output systems;

FIGS. 15A-15C are a raw scan of a sample marking on a road piece, the scan after brightness rescaling, and a final output after classification of the scan;

FIG. 21 is a larger example of a drivable surface that can be stored in the memory of the basestation;

FIGS. 22A-25 are graphs of an A* search used to find the shortest distance between two nodes, namely, node A and node D;

DETAILED DESCRIPTION OF THE INVENTION

Figure 1:
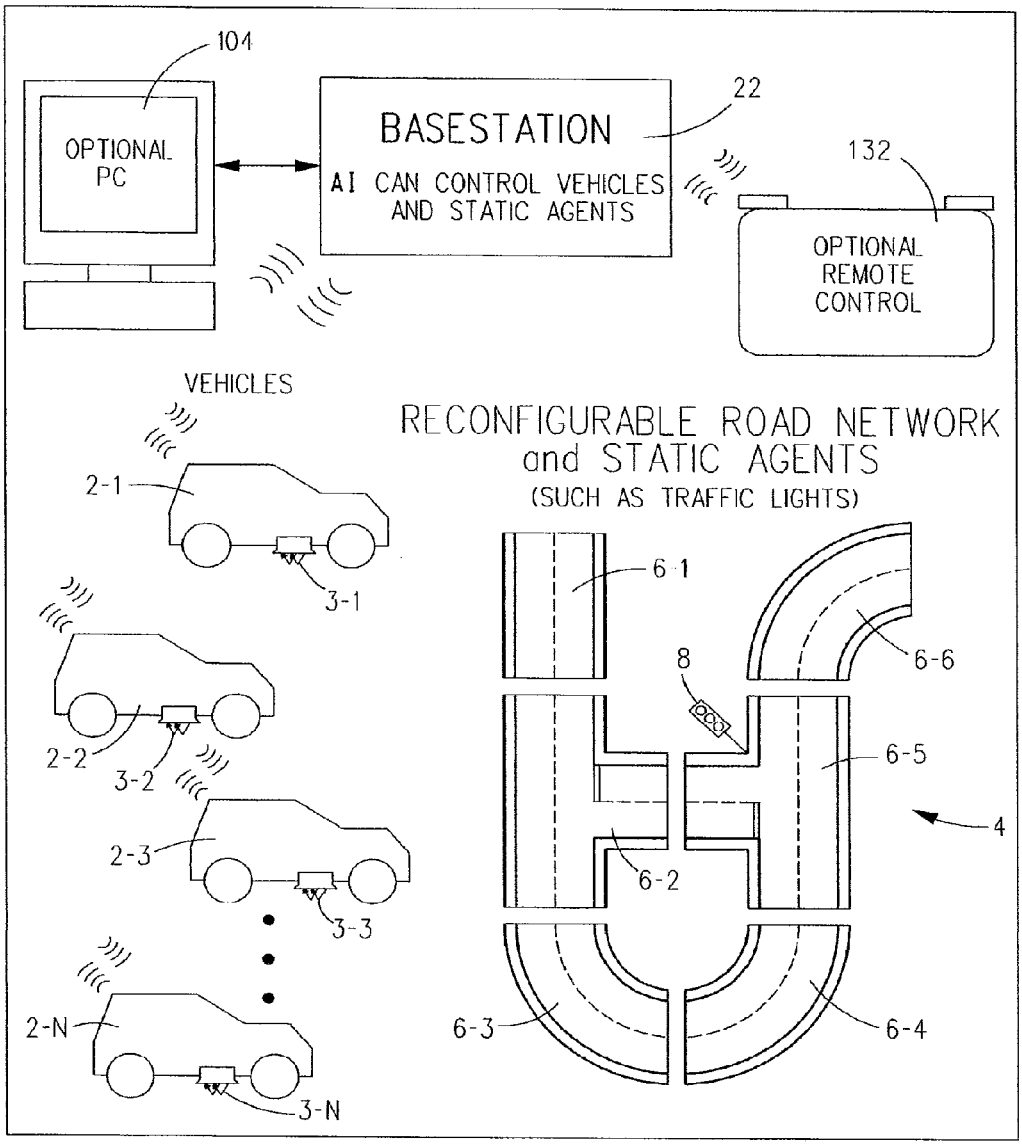
FIG. 1 is an overview of the system components of the present invention, namely, a drivable surface, one or more vehicles, a basestation, and a user interface.

The present invention will be described with reference to the accompanying figures.

The present invention is a system of toy vehicles that can drive autonomously through an environment without being physically constrained to a slot or track. The vehicles use specially designed sensors that allow them to determine their position in an environment. This position information is processed by software (e.g., without limitation, artificial intelligence (AI) software) running on a separate computer or basestation. Operating under the control of this software, the basestation decides on actions for the vehicles and sends them high level controls. Whereas previous vehicles require entirely human control, the software can control the vehicles and can command them to execute complex actions. This allows the vehicles to interact and respond to the actions of other vehicles as well as other objects in the environment.

While each vehicle can be controlled autonomously via the software, hybrid control is also allowed. This allows users to take control of one or more specific vehicles from the basestation. The basestation continues to track the behavior of all of the vehicles and adjusts the behavior of the vehicles not under user control in response to the user-controlled vehicle(s). Users can decide which vehicle(s) is/are controlled by the basestation and which are controlled by the users.

The vehicles drive on a drivable surface which is a series of road pieces (e.g., straight, left turn, right turn, intersection) that are physically connected together. They can drive forward and backwards, and can also turn freely. This is fundamentally different from other toys that utilize connected drivable pieces and are physically constrained to a slot or track. Further, the vehicles use sensing and control technologies to determine the location of the drivable lanes on the road. This allows the vehicles in the system to interact and execute complex behaviors as described above. The vehicles can also choose to leave a road and drive to another part of the environment. This is another significant difference from toys that utilize a slot or track system.

Using encoding technology, position information is embedded into each road piece. As a vehicle travels over a road piece, it emits light that is reflected by the road piece and the reflected light encodes information about the vehicle's position. The vehicle's sensor detects this encoded light and a microcontroller of the vehicle can use it to decode position and other information. This process can be hidden from users by using emitted and reflected light that is outside the normal human visible spectrum (e.g., infrared or ultra-violet).

The system has two primary modes of operation, racing and non-racing. In racing mode, the road pieces are designed like a race track, and many vehicles can travel in close physical proximity to each other as they travel around the drivable surface. In non-racing mode, the road pieces are designed like standard streets and highways such as those found in typical urban driving. Here the lanes are appropriately spaced apart and vehicles can choose to follow traffic rules and deal in appropriate ways with other vehicles and road situations. These two modes can be combined together to build drivable surfaces that have both racing and non-racing sections.

With reference to FIG. 1, the system has four major components:

Drivable surface 6—These are physical models of roads that can include relevant objects such as stop signs, traffic lights 8, and railroad crossings.

Vehicles 2—The vehicles are mobile agents in the system capable of independent motion. They can be physically modeled after cars, trucks, ambulances, etc., animals, or any other desired form. Each vehicle includes one or more sensors 3 that can read information from the drivable surface and a communication module that can send and receive (desirably wirelessly) commands from a basestation.

Basestation 22—The basestation is a separate software controlled computer. Under the control of its software, the basestation maintains the state of the vehicles and other agents and sends and receives commands to and from the vehicles and other agents in the system. The computer can be a general purpose computer, a video game console, and the like, that the software configures to implement the present invention in the manner described hereinafter. The software can be permanently or dynamically stored on any suitable and/or desirable computer readable medium that facilitates operation of the computer under the control of the software. Non-limiting examples of suitable computer readable medium include RAM, ROM, EPROM, optical disks, flash drives, magnetic storage medium, and the like.

User Interface 104/132—The user interface includes all the hardware and software that a human uses to interact with the system.

1 Road Pieces:

With continuing reference to FIG. 1, vehicles 2 drive on a surface 4 that includes individual road pieces 6 that connect at specified connection points and can be reconfigured to construct any desired structure. This structure is referred to as a drivable surface. Basic drivable surfaces can be created from a series of straight road pieces 6-1; 90-degree turn road pieces 6-3, 6-4, and 6-6; and intersection pieces 6-2, 6-5, but more sophisticated drivable surfaces can be created from more complex road pieces. Road pieces 6 include continuous regions that one or more vehicles can navigate called drivable sections and connect to each other end-to-end using a simple click-in mechanism present at each connection point. Each road piece 6 can also transmit power to an adjacent road piece 6 and can optionally include a microcontroller for advanced functionality, such as traffic lights 8.

Figure 2:
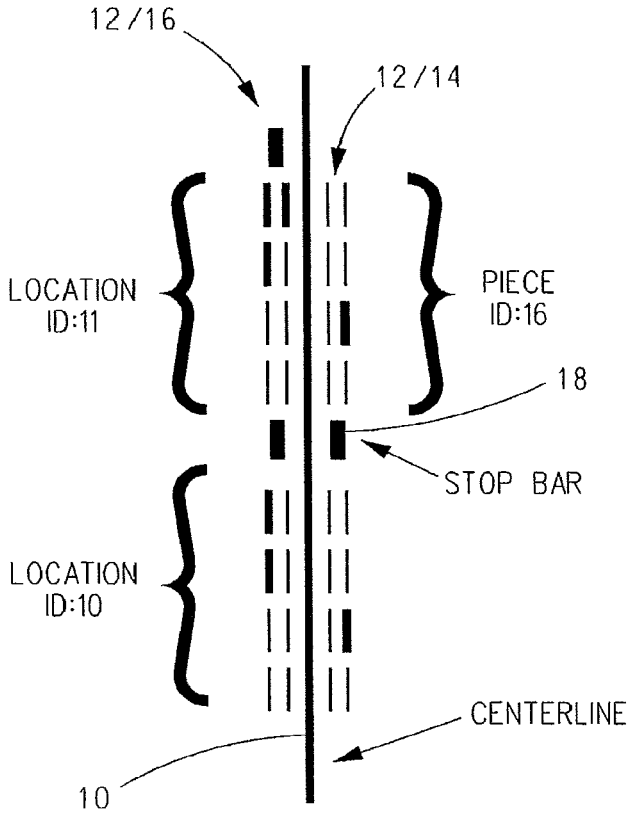
FIG. 2 are exemplary markings that may be included on the road pieces shown in FIG. 1, wherein the markings encode information regarding the identity of the type of road piece, e.g., straight, intersection, etc., a unique location on the road piece, and a center line suggesting an optimal position for the vehicle if it desires to stay within its lane.

1.1 Piece Location and Type Identification:

With reference to FIG. 2 and with continuing reference to FIG. 1, each vehicle 2 identifies its position in the drivable surface by reading markings 12 on road pieces 6 as it drives over them using a vehicle onboard imaging system 3. Herein, the road markings are shown in black on white background for readability and easier understanding. However, these road markings can be made invisible to the human eye and the drivable surfaces can have any color.

These markings 12 can encode information such as the identity of the type of road piece 6 the vehicle 2 is currently driving on (e.g., straight, intersection, etc.), unique locations on that road piece 6, and a line 10 to suggest an optimal position for the vehicle 2 if it desires to stay within its lane. Herein, this line will be referred to as a center-line 10 but it is important to realize that the vehicle 2 is in no way required or constrained to follow this line. In the example shown in FIG. 2, a center-line 10 appears at the center of the drivable lane to allow the vehicle 2 to steer within that lane. Periodically along one or both sides of center-line 10 are a series of rows of markings 12 that encode the piece ID 14 (e.g., right of center-line 10) and the unique location 16 (e.g., left of the center-line 10) identifications (IDs) throughout the lane. While rows of markings are described herein, this is not to be construed as limiting the invention as it is envisioned that any suitable and/or desirable set of markings (arranged in one or more rows or some other configuration(s)) capable of performing the same function as the rows of markings described herein can be utilized. These identifications can include varying-thickness bars where each encodes a unique value. While in the examples discussed herein, each bar is either thin or thick representing a 0 or 1 in a binary encoding of information, respectively, the number of unique bar thicknesses can be variable and depend primarily on the accuracy and resolution of the vehicle 2 imaging system 3. Depending on the number of unique piece or location IDs, each ID is encoded over one or more consecutive rows of markings 12. A single thicker bar 18, herein a "stop-bar" can replace all bars on either side of center-line 10 to mark the completion of each piece or location ID. It is desirable to have a buffer of space between the extremes of the road markings and the boundaries of the total viewable area of the vehicle imaging system to allow for translational errors that might naturally occur during driving.

Each piece ID 14 encodes a unique piece type within the network and remains constant throughout a road piece 6. Each location ID 16 encodes a unique location on that particular road piece 6 and counts up, desirably, from 0. The example segment of FIG. 2 encodes 8-bit piece and location IDs 14, 16 over four consecutive rows (allowing up to 256 unique IDs for each) and, as shown, identifies the piece as being of type 16 and includes two location IDs 16 ("ID:11" and "ID:12")) to identify unique positions on that piece.

Since piece and location IDs 14, 16 are assumed to be of the same bit-length, stop-bars normally appear on each side of center-line 10 simultaneously. Thus, one can therefore represent special information from each road piece 6 at locations that have a stop-bar only on one side and a normal marking on the other. Such techniques can be used to encode the direction of the road piece 6 (left, straight, or right) in the first marking row of each road piece to suggest a steering direction to vehicle control software (discussed hereinafter).

Figure 3:
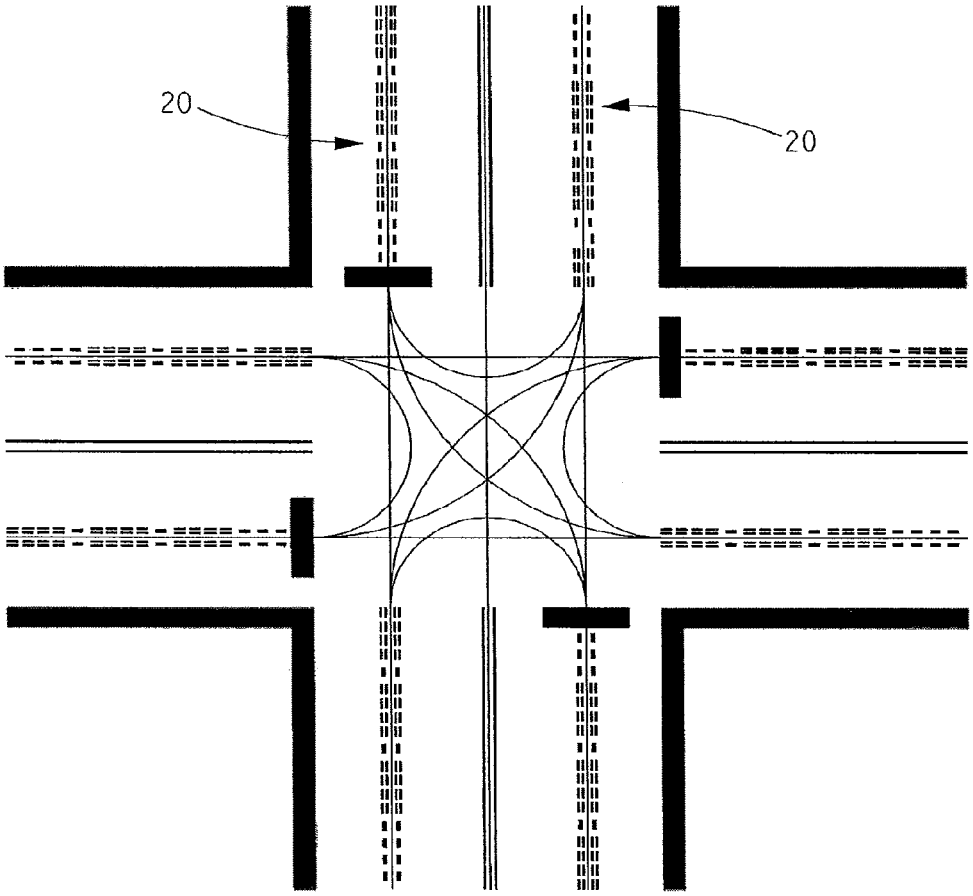
FIGS. 3-5 are examples of an intersection road piece for a street driving mode of the invention, a multi-lane straight road piece for a street driving mode of the invention, and a multi-lane curved road piece for a racing mode of the invention, respectively.
Figure 4:
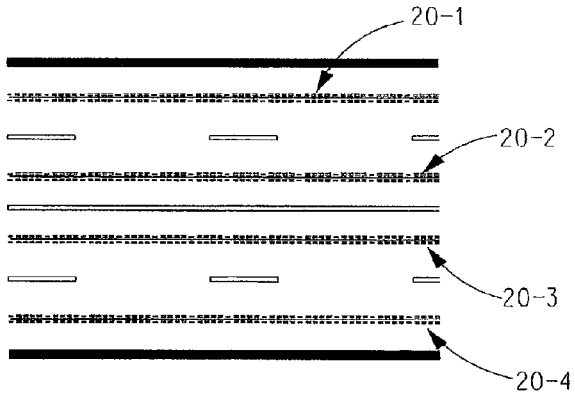
Figure 5:
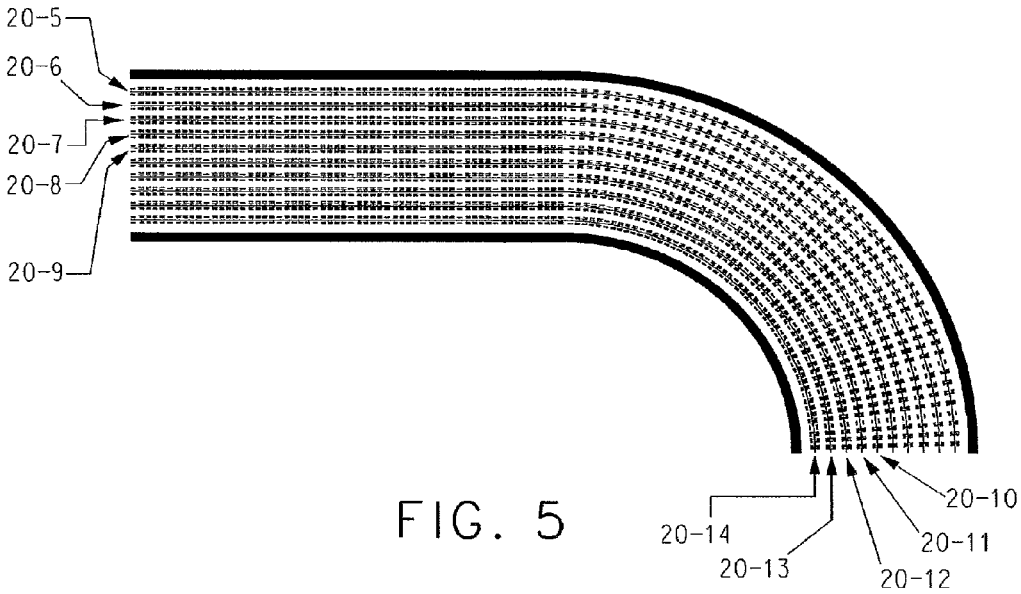

With reference to FIGS. 3-5 and with continuing reference to FIGS. 1-2, when a road piece 6 includes multiple lanes 20, each lane 20 can include such markings. Since location IDs 16 are unique everywhere on the road piece 6, this allows a vehicle 2 to identify on which lane it is currently driving.

Desirably, some of the information encoded in the markings 12 is interpreted directly by the vehicle 2, while other portions are relayed back to basestation 22. Basestation 22 interprets the codes parsed by the vehicle 2 from these markings 12 and has an internal (virtual) representation of the drivable surface and each possible road piece 6 type, allowing it to identify each vehicle's 2 exact position in the drivable surface and consider this position and the positions of other vehicles in the drivable surface in its commanded behaviors of the vehicle 2. This also allows future expansion or custom-built road pieces 6 with only small software updates to basestation 22 rather than having to also update each vehicle 2.

A software tool used to generate road piece 6 marking schemes can be used to generate road piece surfaces while customizing a variety of parameters including but not limited to bar widths, spacing between bars, spacing between marking rows, the number of marking rows per full location or piece ID, the number of lanes in each direction of traffic, road piece length, road piece curvature, etc. A final option allows the addition of a checksum bar on each marking row to serve as an error checking tool by encoding the parity of the remaining bars.

Such an encoding scheme is not possible within an intersection (shown in FIG. 3) due to many crossing paths. For this reason, location and piece IDs 14, 16 cease and only center-lines 10 continue within intersections. This enables a vehicle 2 to follow the appropriate center-line 10 through an intersection to a desired exit point where it can resume marking-based position estimation.

The same road piece structure can be used for both street driving and racing versions of the system, except that for the racing version, road pieces are single direction and include tightly-spaced lanes (see e.g., FIG. 5). In racing mode, this allows vehicles 2 to shift in either direction in the lane at a finer granularity, while for the street mode this allows realistic lane changing behaviors.

Markings 12 serve several purposes. First, markings 12 allow vehicles 2 to identify the road piece 6 type that they are on during drivable surface initialization (described hereinafter). Next, markings 12 allow the encoding of various parameters, such as the curvature direction of the road piece 6 upon entering a new road piece 6, thus enabling vehicles 2 to better handle control-related challenges. Additionally, markings 12 provide position estimates at sufficiently fine resolutions to allow basestation 22 to create high-level plans and interactive behaviors for vehicles 2. Finally, each vehicle 2 is able to accurately maintain a heading within a lane 20 using the center-line 10 and estimate its speed and acceleration using the periods of time for which markings are visible or not visible since the precise lengths of the bars and spaces between them are known.

1.2 Structure Identification:

Desirably, basestation 22 knows the exact structure of the drivable surface. Since a user is free to reconfigure the road pieces 6 at any time, there are a variety of techniques that enable basestation 22 to identify the structure of the drivable surface. This structure is defined by a series of road piece 6 connections. For example, knowing all road piece 6 types and that, for example, connection point "2" of road piece "5" connects to connection point "1" of road piece "7" informs basestation 22 the exact relative position and orientation of the two road pieces and, if one of the road pieces is already fixed, this anchors the other's global position in the drivable surface. Since connection information is often redundant, the structure can be uniquely identified without exhaustively identifying all connection pairs. Once all road pieces are anchored to the global coordinate frame, basestation 22 has complete knowledge about the structure of the drivable surface.

In the following section, three techniques are described how the exact structure of a drivable surface can be determined by basestation 22.

1.2.1 Reading from File:

The easiest way to identify the drivable surface is to read its definition from a user-defined definition file. This is a simple and effective method, especially for development purposes.

Figure 6:
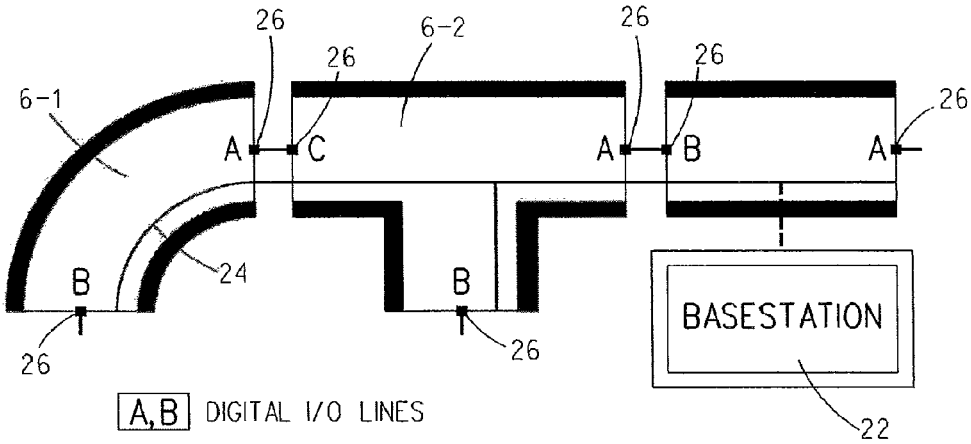
FIG. 6 is an illustration of three road pieces and their connection points, and a basestation connected to a bus system of the road pieces, wherein each road piece includes a controller that facilitates communication with other road pieces.

1.2.2 Instant Electronic Identification:

With reference to FIG. 6 and with continuing reference to all previous Figures, a second technique is possible with road pieces 6 that also include low cost electronics (e.g., a microcontroller). When road pieces 6 are connected to each other, the electronics in each of them are also connected and build a logic network where each road piece 6 can talk to its direct neighbors. All road pieces 6 and basestation 22 are connected via a BUS system 24, where the road pieces 6 are slaves and answer to the basestation's 22 requests. An example of a very efficient bus system for this purpose is a ONE-WIRE-BUS from Dallas Semiconductor, where communication occurs over the standard power and ground lines.

Using bus system 24, basestation 22 can determine which road pieces 6 are in the network. Besides the bus itself, each road piece 6 needs only one digital input/output line per connector. An input/output line allows a microcontroller in each road piece 6 to choose whether the line is used as an input line to read a signal or an output line to generate a signal. For example, a straight road piece has two connectors 26 (one on each end), and each connector 26 has one digital input/output line. A four-way intersection piece has four connectors 26 and therefore four digital input/output lines, one per connection point. FIG. 6 is an illustration of road pieces 6 connected to each other and basestation 22 in such a way.

In this setup, a single digital I/O line per connection and a minimalistic bus system are enough to allow basestation 22 to exactly determine the structure of the connected road pieces 6. This is achieved by basestation 22 causing the digital I/O lines on each road piece to sequentially turn-on, while all the other I/O lines are configured as inputs and listen for signals. Then, basestation 22 interrogates each road piece 6 if and where it saw an ON signal. The following describes the method used to determine the road structure using the example in FIG. 6.

1.2.2.1 Initialization:

With reference to FIG. 6, using bus system 24, basestation 22 determines which road pieces are in the network. In the example above it sees road pieces 6-1, 6-2 and 6-3. At this point, how the pieces are connected to each other is not known.

1.2.2.1.1 Determine Structure:

1. Basestation 22 tells the microcontrollers of all the road pieces 6 to configure their I/O lines as inputs.
2. Basestation 22 tells the microcontrollers of road piece 6-1 to set I/O line A as output and set it to ON.
3. Basestation 22 asks the microcontrollers of all of the road pieces 6 whether they see an ON signal.
4. The microcontroller of road piece 6-2 will respond that it sees an ON signal on its I/O line C.
5. Basestation 22 now knows that road piece 6-1, I/O line A is connected to road piece 6-2 I/O line C.
6. Basestation 22 tells the microcontroller of all the road pieces 6 to configure their I/O lines as inputs.
7. Basestation 22 tells road piece 6-1 to set line B as output and turn it ON.
8. Basestation 22 again asks all of the road pieces 6 whether they see an ON signal.
9. No piece will respond.
10. Basestation now knows that road piece 6-1, I/O line B is NOT connected.

These steps are repeated for each unknown connection until the drivable surface structure is fully identified. This method is extremely efficient (the computational complexity scales linearly with the number of road pieces 6 in the network) so basestation 22 can react quickly to any changes in the structure. The bus system is interchangeable with possible alternatives including SPI, CAN, I2C, One-Wire, or a wireless network technology, as long as bus 24 is capable of determining unique IDs from each node and connection point.

Figure 7:
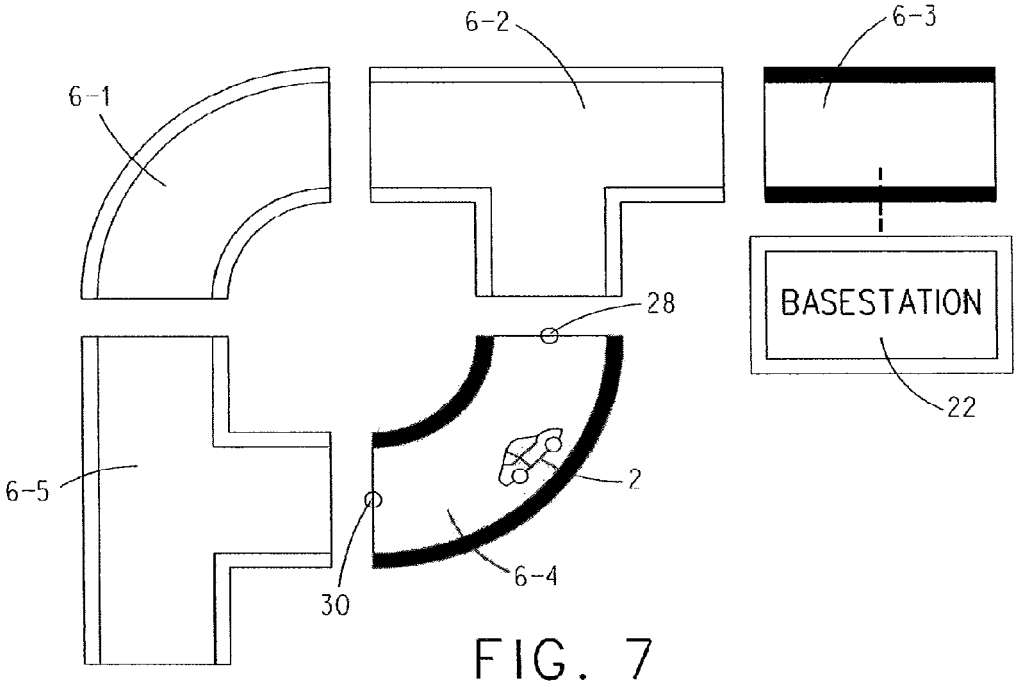
FIGS. 7-9 are illustrations of a drivable surface including road pieces that vehicles drive on to discover the layout of the drivable surface.
Figure 8:
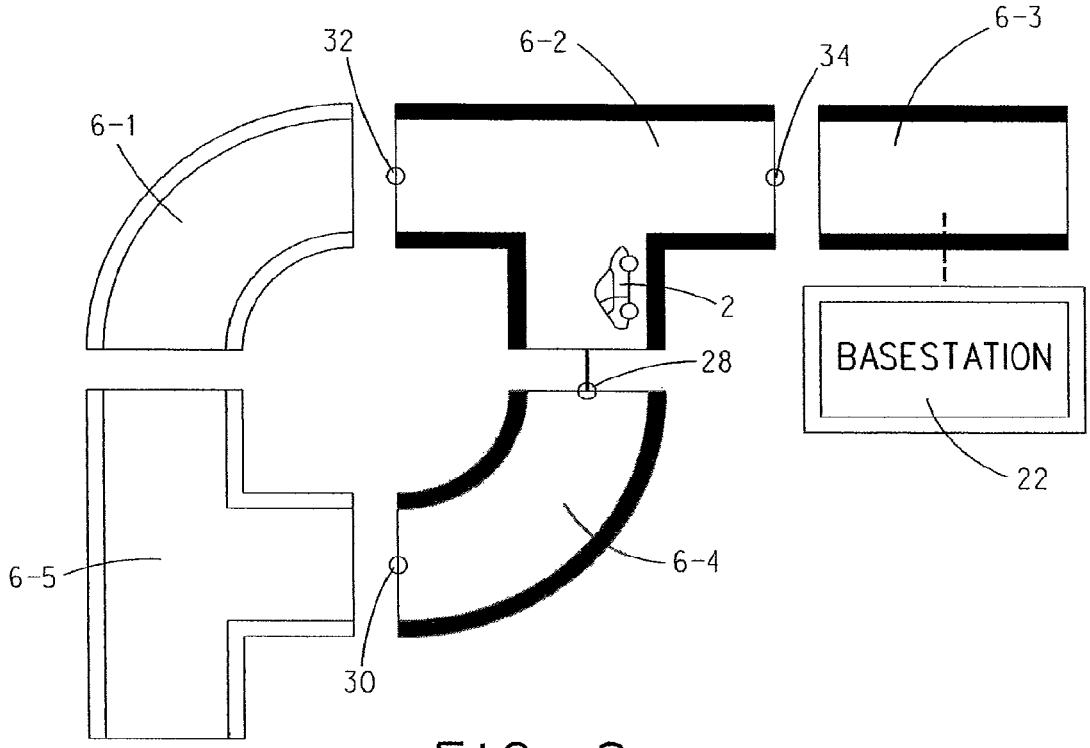
Figure 9:
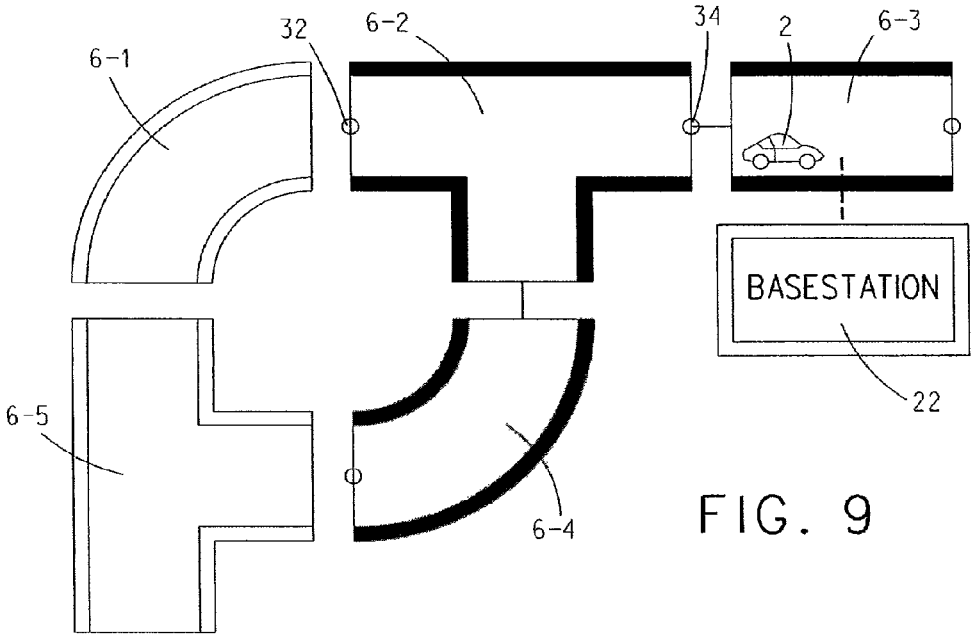

1.2.3 Exploring Vehicles:

With reference to FIGS. 7-9 and with continuing reference to all previous Figs., another method to identify the drivable surface structure is to construct the network using one or more vehicles 2. As a vehicle 2 drives (transitions) from road piece 6 to road piece 6, it identifies the road piece 6 types using its vehicle imaging systems 3. Basestation 22 knows the specifications of each road piece 6 type and can therefore use these transitions to expand its internal drivable surface graph or virtual representation of the drivable surface. In order for this to work, basestation 22 must have a known reference road piece 6 in the drivable surface to anchor the drivable sections graph. This known reference position can be a single road piece 6 with unique type that must be included within each drivable surface. This road piece 6 could be physically connected to basestation 22 to ensure that the rest of the network is built off of it. Since there can be many instances of other road piece 6 types but only one of this special type, we are guaranteed to be able to uniquely identify any drivable surface.

A method to accomplish this task with one vehicle 2 is to track unexplored road piece 6 connection points as this drivable surface is constructed and repeatedly plan paths through the closest unexplored exit until no unexplored exits remain. An example of this method is illustrated in FIGS. 7-9.

In FIG. 7, the system is started with an unknown drivable surface configuration. The basestation's road piece 6-3 is known and used as an anchor point in the network and basestation 22 is able to identify road piece 6-4 as the road piece vehicle 2 is on based on the road piece 6 markings 12 parsed by vehicle 2 to basestation 22. The two unexplored road piece connections 28, 30 are remembered for future exploration.

As shown in FIG. 8, basestation 22 commands vehicle 2 to explore the top connection point 28, resulting in basestation 22 knowing that road pieces 6-2 and 6-4 are connected (and their relative orientation), as well as the two new unexplored connections 32 and 34 to road pieces 6-1 and 6-3, respectively.

As shown in FIG. 9, basestation 22 then commands vehicle 2 to take the right-most connection 34, resulting in basestation 22 now knowing that the drivable surface includes road pieces 6-2, 6-3 and 6-4 as well as their orientations and how they are anchored to the basestation road piece 6-3. This approach continues until no unexplored connections remain.

Multiple vehicles 2 can more quickly identify the drivable surface representation when doing this processing simultaneously but must take into account any uncertainty in their locations in order to prevent collisions. For example, two intersection road pieces 6 in the system may have the same type so the vehicles 2 must be sure that if there is uncertainty about which piece they are on, they are performing actions that under any possible scenario will not cause them to collide during exploration.

While this approach results in cheaper road pieces 6 since we reuse existing vehicles 2 and imaging systems 3 for drivable surface identification, it requires a full drivable surface exploration by vehicles 2 each time a change is made.

1.2.4 Ability to Print Custom Networks:

Optionally, software can be provided that runs on an optional general purpose computer and which gives a user the ability to design drivable surfaces having custom road pieces. While standard road pieces 6 will include the most common types, such as without limitation, straight sections, turns, intersections etc., some users may want to custom-design non-standard road pieces 6. This software will allow the user to do so, or even design entire sophisticated drivable surfaces. For example, a user could design a single, sharp 45 degree turn or a large scale racing track with extra wide roads and pit stop exits.

Using this software, the user can request that each non-standard road piece 6 or even an entire drivable surface be printed on, for example, without limitation, paper or transparency. The user can then attach this printout to his preferred surface.

The software can also provide a definition file for the custom designed network which can be uploaded to the user's basestation 22, so that the basestation 22 understands the custom road piece(s) 22 and/or drivable surface and can plan appropriate actions for the vehicles 2.

Figure 10:
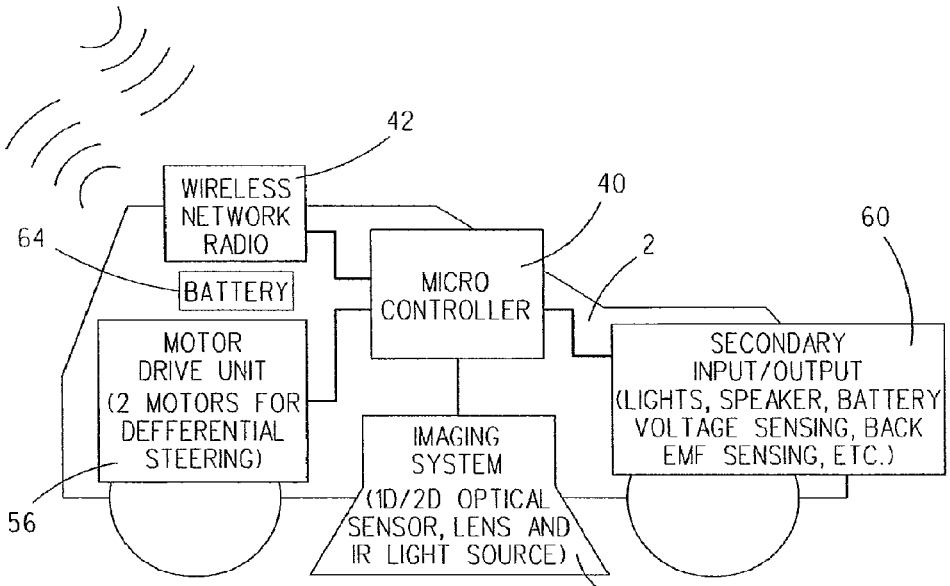
FIG. 10 is a block diagram of a vehicle of the present invention that includes a microcontroller including supporting hardware (RAM, ROM, etc.) that operates under the control of an embedded software program, a wireless radio network, a motor drive unit, an imaging system, and a secondary input/output system, all running under the control of the microcontroller.

2 Vehicles:

With reference to FIG. 10 and with continuing reference to all previous Figs., vehicles 2 are special mobile parts of the system which can freely move on predefined drivable road pieces 6 as described previously. Vehicle 2 motions are not constrained by a physical barrier like a slot or track. Rather, vehicle 2 can freely move anywhere along these road pieces 6. To allow such behavior, vehicle 2 has a vehicle imaging system 3 that enables vehicles to estimate its position in the drivable surface and vehicle 2 is in periodic wireless contact with basestation 22.

Each vehicle 2 can be fully controlled by basestation 22 or through hybrid control between a user via a remote control 132 and basestation 22. If a user controls a vehicle 2, he can choose to have the vehicle 2/basestation 22 handle low level controls such as steering, staying within lanes, etc., allowing the user to interact with the system at a higher level through commands such as changing speed, turning directions, honking, etc. This is useful since vehicles 2 are small and can move fast, making it difficult for a human to control the steering.

2.1 Vehicle System Components:

Vehicles 2 described herein are different from remote controlled toy cars available today. To allow for the above-described behaviors, vehicles 2 include various robotics and sensor technologies. Each vehicle 2 includes five main system components described in the following sections and illustrated in FIG. 10.

2.1.1 Microcontroller:

A microcontroller 40 is the main computer on each vehicle 2. It performs all the control functions necessary to allow vehicle 2 to drive, sense, and communicate with basestation 22 and monitor its current state (like position in the drivable surface, speed, battery voltage, etc.). Desirably, microcontroller 40 is low cost, consumes little power but is powerful enough to intelligently deal with large amounts of sensor data, communications requirements, and perform high speed steering and speed control. Microcontroller 40 includes a variety of peripheral devices such as timers, PWM (pulse width modulated) outputs, A/D converters, UARTS, general purpose I/O pins, etc. One example of a suitable microcontroller 40 is the LPC210x with ARM7 core from NXP.

2.1.2 Wireless Network Radio:

Each vehicle 2 includes a wireless network radio 42 (i.e., a wireless radio transceiver) operating under the control of microcontroller 40 to facilitate communication between microcontroller 40 and basestation 22. Potentially, many vehicles may be driving on the drivable surface simultaneously and basestation 22 needs to communicate with all of them, regardless of whether they are controlled by users, by basestation 22, or both. This means that vehicles 2, traffic lights 8, basestation 22, and remote controls 132 for user interaction can be part of a wireless network which can handle multiple (potentially hundreds of) nodes. The network topology can be set up as a star network, where each vehicle 2, remote control 132, etc. can communicate only with basestation 22, which then communicates with vehicles 22, remote control 132, etc. The second possibility is to choose a mesh network topology, where nodes can communicate directly with other nodes.

The star network version is simpler and requires less code space on microcontroller 40 but still fulfills all the requirements needed for the system. Examples of suitable wireless network technologies include ZigBee (IEEE/802.15.4), WiFi, Bluetooth (depending on the capabilities of future versions), etc. Specifically, ZigBee (IEEE/802.15.4) or related derivatives like SimpliciTI from Texas Instruments offer the desired functionality like data rate, low power consumption, small footprint and low component cost.

Figures 12A, 12B, 12C:
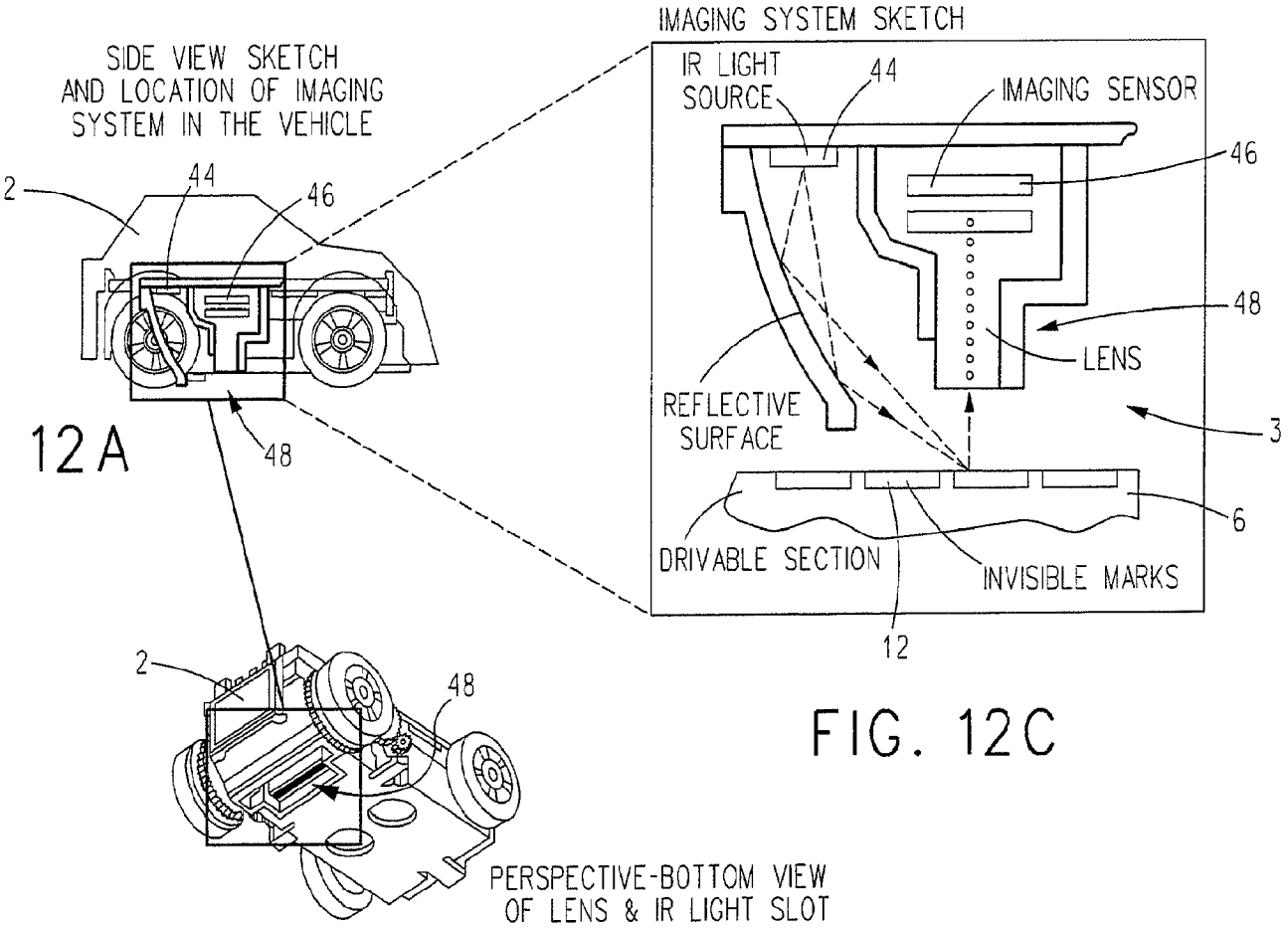
FIG. 12A is a schematic view showing details of the vehicle imaging system of FIG. 10 in an outline of a vehicle.
FIG. 12B is a perspective view of an exemplary location of the slot of the vehicle imaging system of FIG. 12A.
FIG. 12C is an isolated schematic view of the vehicle imaging system of the vehicle of FIG. 12A.

2.1.3 Imaging System:

The imaging system 3 of vehicle 2 allows the vehicle 2 to determine its location in the drivable surface. A 1D/2D CMOS imaging sensor 46 (shown in FIG. 12A) inside vehicle 2 facing the surface of the drivable road piece underneath is used to take images of the surface at high frequencies (at times up to 500 Hz or more).

As described above, road pieces 6 include a structured pattern of optical markings 12 that are desirably visible only in the near infrared spectrum (NIR), in the IR (infrared) spectrum or in the UV (ultra violet) spectrum, and are completely invisible to the human eye. This is achieved by a very specific combination of IR, NIR, or UV blocking ink and a matching IR, NIR, or UV light source. Invisible markings are desired since the markings are not visible to the user, making the appearance of road pieces 6 closer match that of real roads. However, without changes in the hardware, the same system works with visible ink as well (such as black), allowing users to print their own road pieces on a standard printer without having to buy special cartridges. The 1D/2D CMOS imaging sensor in the vehicle, together with an LED light source 44 (shown in FIG. 12C) emitting light at a specific (for example NIR) frequency, can read those markings and interpret them.

Figure 11A:
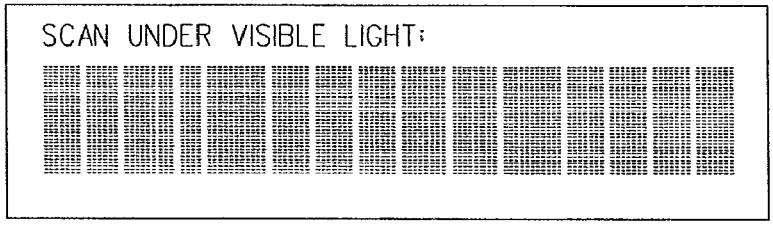
FIGS. 11A and 11B are scans of the markings on the road pieces by an imaging sensor of the imaging system of the vehicle shown in FIG. 10 using visible light and using near infrared (NIR) light, respectively.
Figure 11B:
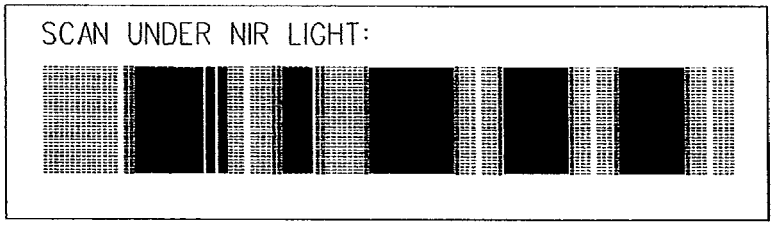

For example, a 1D linear pixel array TSL3301 from TAOS INC or a MLX90255BC from Melexis can be used as the image sensor 46. The image of the surface of a road piece 16 can be focused with a SELFOC lens array 48 and illuminated by an NIR LED light source 44 emitting light for example at 790 nm. The pattern of markings 12 on the road pieces 6 would in that case be printed with an ink or dye which absorbs NIR light. The peak absorption frequency is approximately the same wavelength as that at which the LED light source 44 is emitting light, 790 nm in this example. A marking therefore appears black to the imaging system 3 and the surface without a marking appears white (see FIGS. 11A and 11B).

The combination of LED light source 44 with peak emitting frequency approximately equal to the peak absorption frequency of the ink completely eliminates the necessity of a light filter if light from outside light sources can be shielded by the vehicle's body. This is the case with the vehicle 2 design shown in FIG. 12B. The mentioned wavelengths are of course only examples, and any CMOS sensor/LED/ink combination in the NIR/IR spectrum or even UV spectrum would work the same way, and a variety of inks/dyes are available from numerous manufacturers like EPOLIN, MaxMax etc. The microcontroller 40 on the vehicle 2 reads at a high frequency from the imaging system 3 and uses classification algorithms to interpret the markings 12 from each reading. Microcontroller 40 then transmits the parsed markings to basestation 22 via wireless network radio 42 for interpretation into vehicle's 2 global position in the drivable surface.

2.1.3.1 Location within the Vehicle:

With reference to FIGS. 13A-13D and with continuing reference to all previous figures, an important parameter is the distance $d_1$ between the position of the imaging system 3 and the steering axis 50 in a vehicle 2. Since vehicle 2 steers using a differential drive, described hereinafter, the steering axis 50 is the axis along the two drive wheels 58 and the steering point 52 is the center between the two drive wheels 54.

As described herein, imaging system 3 is used to gather sensor information allowing vehicle 2 to steer and keep a desired position on a road piece 6. The distance $d_1$ between the image sensor 46 of imaging system 3 and steering axis 50 is important because it significantly influences a vehicle's 2 capability to steer.

Initially it may seem that imaging system 3 should be located as close as possible to steering axis 50 with the optimal position being at steering point 52 between drive wheels 54 (as shown in FIGS. 13C-13D). This position is considered to be optimal because when vehicle 2 steers, it turns around steering point 52, which would not change the position of imaging system 3, only its orientation. While this introduces a warping effect in how the markings are perceived, it keeps the imaging sensor 46 in the center of the road piece 6 and as far away from the edges of markings 12 as possible.

Unfortunately, vehicle 2 is subject to a certain amount of steering noise caused by limited control over motor behavior, slip, backlash, variable friction and other factors. By positioning imaging system 3 forward from the steering axis (as shown in FIGS. 13A-13B), a small steering error will be amplified into a large effect perceived by the imaging sensor 46 in front of the steering axis 50, allowing the microcontroller 40 to more quickly correct steering errors. This is the reverse of the position of imaging system 3 in FIGS. 13C-13D where any steering error would not become visible to the imaging system 3 until much later and vehicle 2 would have to react quicker to such error.

The optimal position for the imaging system 3 is a tradeoff that must be considered when designing the vehicle 2. If it is positioned too close to the steering axis 50 then the problem mentioned above will occur. On the other hand, if it is positioned too far forward then tiny steering errors will result in large translations for the imaging system 3, possibly adding difficulty to the marking-parsing process. A compromise between the two extremes will allow the vehicle 2 to more easily maintain its heading on a road piece while still enabling consistent parsing of road markings.

Given the size of the vehicles 2 envisioned herein, a large $d_1$ is desirable, for example $d_1$=25 mm. This allows vehicles 2 to be designed without wheel encoders (sensors to measure angular position and velocity of the wheels) or similar sensors. Usually, sensors like wheel encoders are used to allow cars, robots etc. to steer precisely. Without such sensors, the ability of controlling wheel speed is limited, which causes large steering errors. However, in the vehicle 2 design described herein, the vehicle 2 compensates for such steering errors with a large $d_1$, catching a potential steering error early enough to compensate for such error.

As described herein, this causes the imaging system 3 to change position when the vehicle steers, potentially missing parts of underlying road markings. To account for this position change caused by steering errors, the road markings 12 are designed to be smaller than the imaging systems sensor area, leaving large enough margins on either side.

2.1.4 Motor Drive Unit:

With reference to FIGS. 14A and 14B and with continuing reference to all previous Figs., in one embodiment, the motor drive unit 56 uses two micro electric motors 58, one for each rear wheel 54, to enable vehicle 2 to move in a desired direction. Motor drive unit 56 is known as a differential drive system. By controlling the relative speed of each motor 58 (by controlling the voltage applied to the motor), vehicle 2 can steer along arbitrary small curvatures. Microcontroller 40 generates a PWM signal for each motor 58. Each signal is amplified by H-bridge motor drivers (not shown) to output the necessary power for the motor 58.

In another embodiment, the motor drive unit is a single micro electric motor driving at least one rear wheel of the vehicle. Microcontroller 40 generates a PWM signal that is amplified by a motor driver (not shown) to output the necessary power for said motor. In this embodiment, the front wheels of the vehicle can both turn like a real vehicle, e.g., Ackermann steering.

The imaging system 3 described above is also used to estimate a speed of vehicle 2 and steering angle and therefore allows for closed loop speed and steering control. In addition, microcontroller 40 can use a counter-E.M.F. signal from one or both motors 58 to estimate the speed of vehicle 2 at a higher frequency without the need for wheel encoders, but with less accuracy than with the imaging system 3.

2.1.5 Secondary Input/Output:

Each vehicle 2 can also include a secondary input/output system which includes components which are not critical for the core operation of the vehicle 2 but which adds functionality to the vehicle 2 to allow for more realistic performance.

Each vehicle 2 includes a small battery 64 which powers the vehicle 2. The preferred battery type is Lithium Polymer, but other battery technologies can also be used provided the batteries are small. The vehicle uses an A/D converter in series with a voltage divider to enable microcontroller 40 to measure the voltage of the battery. This information is forwarded to basestation 22, which then plans accordingly. When battery 64 is at very low voltages, microcontroller 40 can react immediately and stop the operation of vehicle 2 if necessary. Battery 64 is connected to the bottom of vehicle 2 to supply outside-accessible charging connectors 62, shown in FIG. 14B. Connectors 62 are specially designed to not only allow easy recharge of the vehicle's battery, but also for the vehicle 2 to drive itself onto a charging station (not shown) without the help of a user. This is necessary because the system can include charging stations, where vehicles 2 can be recharged automatically without user intervention. Both the battery and the motors can be mounted in quick change slots to allow a user to change them without the necessity of tools, such as a screwdriver.

Vehicle 2 includes LEDs representing the head-, turn-, and break-lights, and special lights in unique vehicles such as police cars or firetrucks. Operation of those lights is similar to the operation of lights in a real vehicle. Microcontroller 40 controls these lights based on commands received from basestation 22 to show intended actions like turning left, braking, high beams, etc. The last part of the secondary input/output system can be an audio speaker which allows vehicle 2 to generate accoustic signals like honking, motor sounds, yelling drivers, sirens, etc. under the control of basestation 22 via wireless network radio (radio transceiver) 42 and microcontroller 40.

2.2 Vehicle Control Software:

Microcontroller 40 on each vehicle 2 operates under the control of vehicle control software to control the low level, real-time portion of the vehicle behavior, while the high level behaviors are controlled by basestation 22. The vehicle software operates in real-time with sub-system execution occurring within fixed periods or time slots. This means microcontroller 40 executes various tasks such as measuring speed, commanding motor voltage, steering, and checking for messages at different intervals. Hardware timers on microcontroller 40 are used ensure that each task is executed as desired. For example, each microcontroller 40 can take a scan using the imaging system at frequencies between 500 Hz-1000 Hz, command new motor speeds at frequencies between 250 Hz-500 Hz, check for new messages at 100 Hz and check the battery voltage every 10 seconds. Some tasks take longer than others to execute, but they all should execute within their allotted time periods or slots. The vehicle software can be divided into the following sub systems:

2.2.1 Communication:

Each vehicle 2, via its microcontroller 40 and wireless network radio 42, communicates wirelessly via messages with basestation 22 (which also includes a wireless transceiver) and reacts to messages sent by basestation 22. Messages sent by basestation 22 can, for example, but without limitation, include a new desired speed, a new desired acceleration, a lane switch command, request battery voltage, request the latest position information of the vehicle, turn on a turning signal, output a sound, etc. Vehicle 2 can also send messages about its own status without a request from basestation 22. This can happen when, for example, without limitation, the battery voltage is very low or vehicle 2 loses track of its position.

2.2.2 Marking Recognition/Interpretation:

The raw scans of markings 12 taken by imaging system 3 (where each pixel includes a grayscale value in the range of 0 to 255) are parsed by microcontroller 40 into bit values so that piece and location IDs can be computed. This happens through a series of steps shown in FIGS. 15A-15C. First, the raw scan (FIG. 15A) is rescaled so that the brightest pixel (FIG. 15B) has a value of 255. This reduces the impact from scan-to-scan variations due to external conditions such as lighting, surface color, etc.

Figure 16:
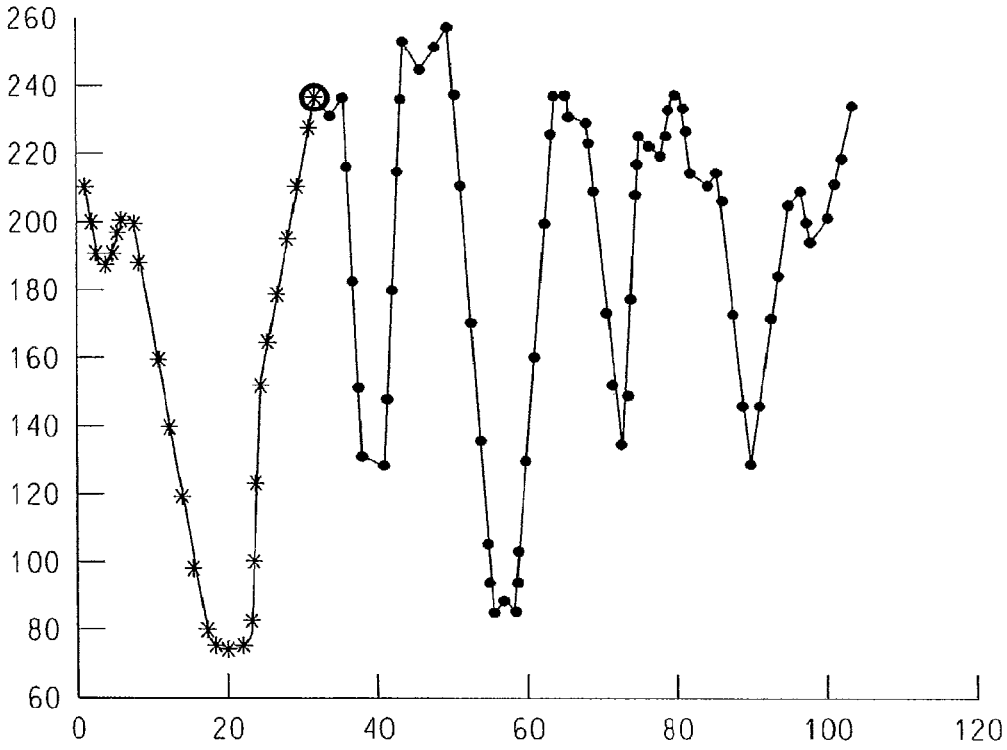
FIG. 16 is a graph illustrating a gradient-following approach utilized on the raw pixel data of FIG. 15A to generate the final classified scan shown in FIG. 15C.

Next, any one or more of a number of techniques can be used to classify the raw pixels of the scan into either black or white (FIG. 15C). The simplest technique involves using a threshold to decide the classification of raw values. This works well when there are few bars per row and they are spaced relatively far apart as in this example. If they are closer, however, the effects of blurring from the bar edges makes a simple threshold approach insufficient for handling the problem. In this case, computationally efficient machine learning approaches trained through hand-labeled scans can be used. Two such techniques include support vector machines (SVMs) and decision trees. Both techniques classify a pixel into white or black using a variety of features computed for that pixel using its value and its neighbors' values. As shown in FIG. 16, a gradient-following approach used on the raw pixel values in each direction from the current pixel can be used to generate features for this continuous set of pixels: the maximum and minimum values of the gradient, the magnitude of this range, where the current pixel lies within that range, etc. SVMs create a linear decision boundary within this feature space (non-linear extensions are possible as well), while decision trees decide on the classification through a series of single feature comparisons. In the gradient following approach, the gradient of pixel values in each direction is determined. In FIG. 16, the gradient is computed for the circled pixel. The highlighted (starred) set of pixel values can be used to generate features that would allow the circle pixel to be classified as "white". The pixel indices are shown along the x axis while the pixel intensities are shown along the y axis.

Once the scan is classified into white and black pixels, the resulting groups of black pixels can be inspected with error-checking techniques to correct for isolated errors and classified into the appropriated type of bar using expected widths of pixels in order to identify the center-line 10 and encoded values in a marking 12 row.

2.2.3 Steering Control Algorithm:

Each vehicle 2 needs to be able to steer precisely and at high speeds to follow a lane (e.g., without limitation, center-line 10) on a road piece 6. Microcontroller 40 on vehicle 2 uses imaging system 3 to not only identify markings from the road pieces 6, but also to compute their horizontal position within the field of view of the imaging sensor 46 of imaging system 3 at a high frequency. Unless otherwise instructed by basestation 22, microcontroller 40 is programmed to try to keep vehicle 2 centered over center-line 10 as seen in an immediately preceding scan by imaging system 3. Microcontroller 40 will compute the position of markings 12 relative to the center of vehicle 2, and if vehicle 2 is not centered, will cause vehicle 2 to steer as needed to move the markings 12 toward the center of vehicle 2. An Open/Closed Loop algorithm is used by microcontroller 40 to achieve that goal.

Figure 17A:
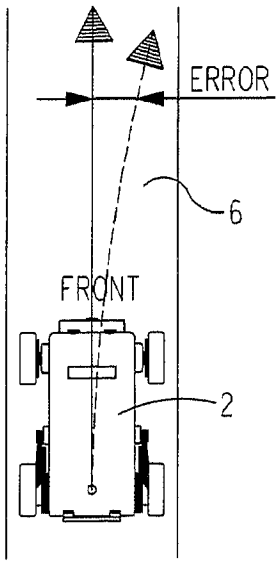
FIGS. 17A-17C show steering control errors for a straight road piece where the vehicle tries to drive using a straight bias, the error if the vehicle tries to drive a left curved road using a straight bias, and a reduction in the error if the vehicle is biased to drive a left curve on the left curved road piece.
Figure 17B:
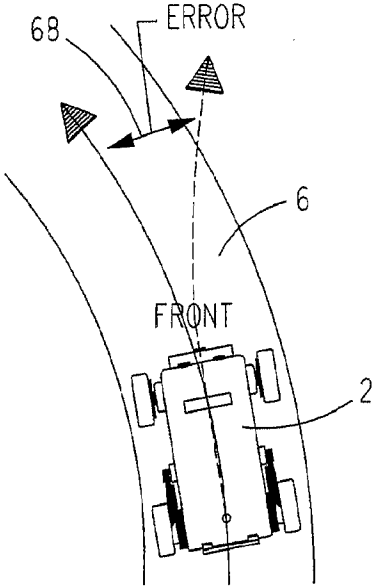
Figure 17C:
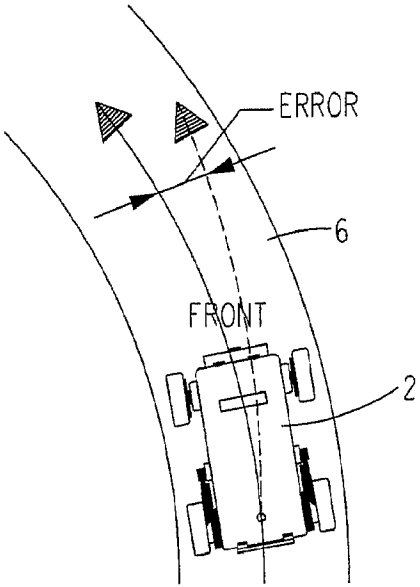

The Closed Loop portion of this algorithm is a PID (Proportional-Integral-Derivative) control which computes the steering angle for the current position error. The Open Loop portion of this algorithm uses prior knowledge embedded in markings 12 on road pieces 6 to determine whether the vehicle 2 is about to traverse a straight road piece (FIG. 17A), left-curved road piece (FIGS. 17B-17C), or right-curved road piece 6. Microcontroller 40 then commands an open loop speed to the motors 58 of vehicle 2 which will drive vehicle 2 on an approximately correct trajectory which is in effect a first guess, or bias, at the appropriate steering commands for that section of road piece 6. The PID controller then works on top of the Open Loop control trajectory to eliminate errors in real time. An example of this behavior is shown in FIGS. 17B-17C. Without the first guess, vehicle 2 tends to drive approximately straight. On a curved road piece 6, this causes a large steering error 68 that the PID control corrects. Using a bias based on prior knowledge (e.g., markings 12 and, thereby, whether vehicle 2 is currently on a straight, left or right curved road piece) significantly reduces the error the PID control needs to correct and therefore makes microcontroller 40 steering of vehicle 2 more stable. To compute a good bias for different maneuvers, like a left or a right turn, data from the driving behavior of vehicle 2 at different speeds, steering angles and across multiple vehicles is analyzed.

If instructed by basestation 22, microcontroller 40 can choose to not center vehicle 2 on road markings 12, but execute a completely free trajectory. This is for example used when vehicle 2 switches from one road lane (e.g., center-line 10) to another.

This capability defines a difference between the present system and prior art toy slot cars or model railroad systems: namely, while prior art toy slot cars or model railroad systems are locked to a physical slot or track and cannot leave it, the present system's vehicles 2 can follow road markings 12 for some time, but can leave them at any time and make frequent use of that capability.

2.2.4 Speed Control Algorithm:

Microcontroller 40 is also responsible for driving vehicle 2 at a desired speed. Microcontroller 40 utilizes an open loop/closed loop speed control algorithm for speed control. The Open Loop speed control part commands an open loop speed to the motors 58 which will make the vehicle 2 drive at approximately the correct forward speed. The parsed road markings 12 acquired by the vehicle imaging system 3 are used to measure the amount of time it took vehicle 2 to travel over known lengths of the parsed road markings 12. This is converted by microcontroller 40 into the actual current forward speed of vehicle 2. Then, a closed loop (PID) speed control is used by the microcontroller 40 to eliminate the difference between the desired/commanded speed and the current speed of the vehicle 2.

As described above, forward speed estimation is performed by measuring the length of time vehicle imaging system 3 of vehicle 2 sees a row of markings 12. Since the length of each of these rows is known, the measured length of time for which the bars comprising each marking 12 are seen can be translated to an estimated speed of vehicle 2.

It is also desirable to measure lateral speed during lane changes to enable the speed of lane changes to be specified and controlled, allowing more accurate and diverse plans that involve both smooth and sharp lane change decisions through improved predictability of the vehicle's 2 motion. Also, this reduces the possibility of switching an incorrect number of lanes by always tracking the lateral distance traveled so far. This allows planning of large actions across many lanes at once rather than making a series of small single-lane transitions due to uncertainty concerns.

Rather than tracking the duration of a seen marking 12 as in the forward-motion case, lateral speed estimation works by tracking the lateral motion of the center-lines 10 of all markings 12 visible by the vehicle imaging system 3 throughout the lane transition. At every scan by the vehicle imaging system 3, the pixel positions of all visible bars' center-lines 10 are computed and compared against the positions from the previous scan. At a high enough scan frequency, these positions will move a maximum of a few pixels between scans, allowing microcontroller 40 to accurately match bars from consecutive scans. Microcontroller 40 tracks the overall progress of a reference center-line 10 and switches to another center-line 10 which becomes the new reference center-line 10 as soon as the current reference center-line 10 leaves the field of view, allowing uninterrupted lateral tracking throughout the entire motion.

By trading off between center-lines 10 as they pass through the field of a view of vehicle imaging system 3, microcontroller 40 can estimate an overall amount of horizontal translation in numbers of pixels from some starting point, even when the total translation is much greater than the width of the vehicle imaging system's 3 field of view. Since the distances between lanes are known, microcontroller 40 can execute a lane change at a given lateral speed by adjusting the heading of vehicle 2 by minimizing the difference between a calculated/determined lateral progress and a desired lateral progress at each point in time. If vehicle 2 is falling behind in its lateral progress, microcontroller 40 can cause vehicle 2 to turn sharper to catch up and if vehicle 2 is shifting laterally too quickly, microcontroller 40 can cause vehicle 2 to straighten its heading relative to the road piece 6 to slow down its lateral progress and reduce error.

This provides a high degree of accuracy in lateral speed control since at least one center-line 10 is visible in a majority of locations on the road pieces (note that fully parsing the marking row is not necessary for this computation). In a minority of situations where no markings 12 or center-lines 10 are visible, the current lateral motion can be estimated from the last-measured rate of lateral motion.

Figure 38A:
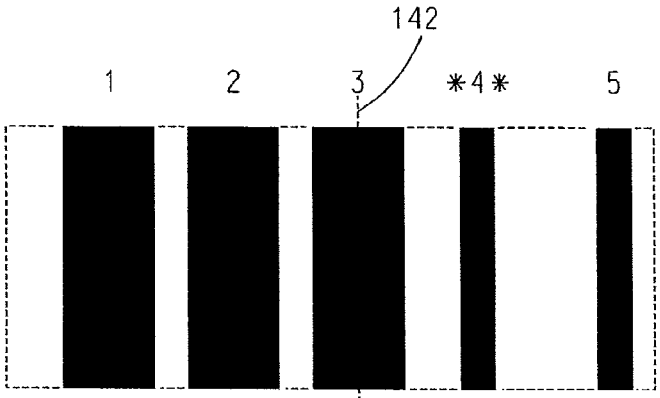
FIGS. 38A-38C are an example of a lateral speed estimation approach that can be executed by each vehicle.
Figure 38B:
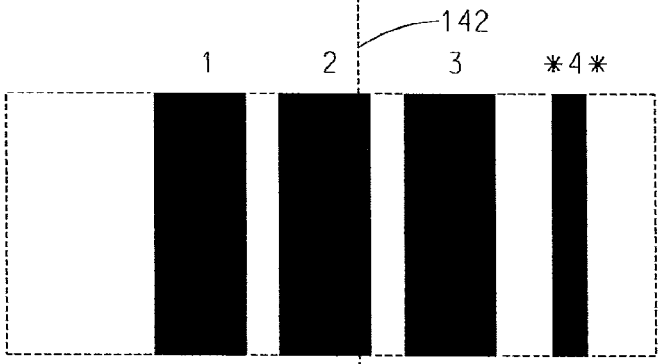
Figure 38C:
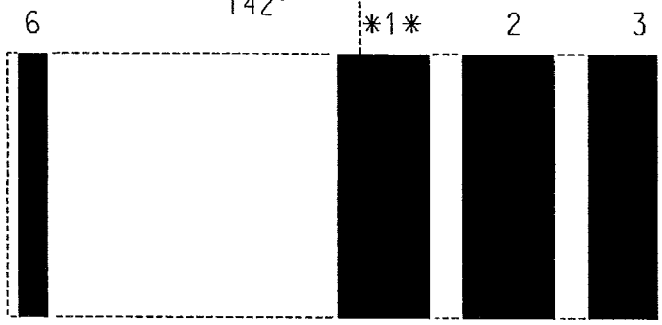

An example of this latter approach is shown in FIGS. 38A-38C over three points in time. Here, vehicle 2 initiates a lane switch to the left. Initially, as shown in FIG. 38A, the entire marking row is centered (shown by dashed line 142) in the vehicle imaging system's 3 visible area. Five bars are identified and microcontroller 40 decides to track the fourth bar *4*. As the vehicle 2 shifts to the left as shown in FIG. 38B, bars begin to leave the visible area to the right. As the bar that was being tracked leaves the field of view, as shown in FIG. 38B, microcontroller 40 begins to track its progress using the first bar (bar number *1*, in FIG. 38C) instead, allowing vehicle 2 to maintain an estimate of overall lateral motion progress since the start of the lane change maneuver, even as bars enter and leave the field of view of the vehicle's imaging system 3. In FIG. 38C, the beginnings of another marking row to the left begin to appear, and will be used to track motion when the first marking row's bars are no longer visible.

Figure 39:
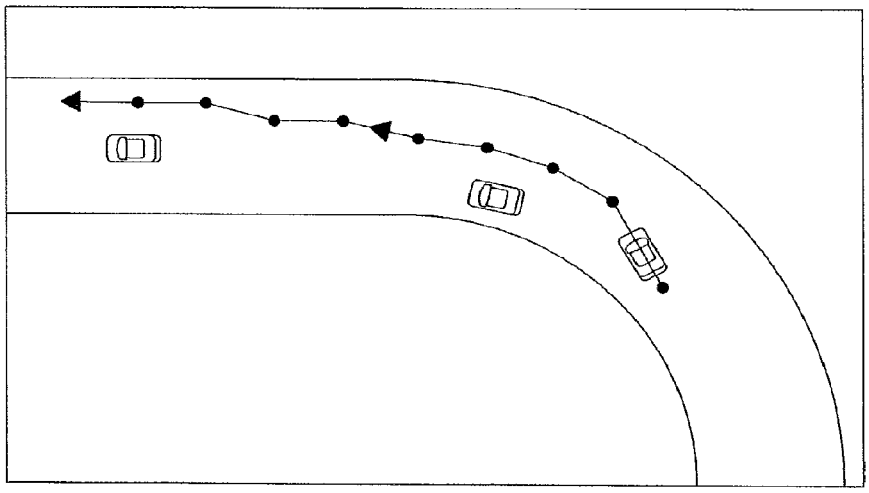
FIG. 39 is an example of a maneuver that can be taken by a vehicle 2 utilizing the lateral speed estimation approach described in connection with FIGS. 38A-38C.

Precise lateral motion execution through techniques such as this is necessary to enable vehicle 2 to execute maneuvers such as the one shown in FIG. 39.

Figure 18:
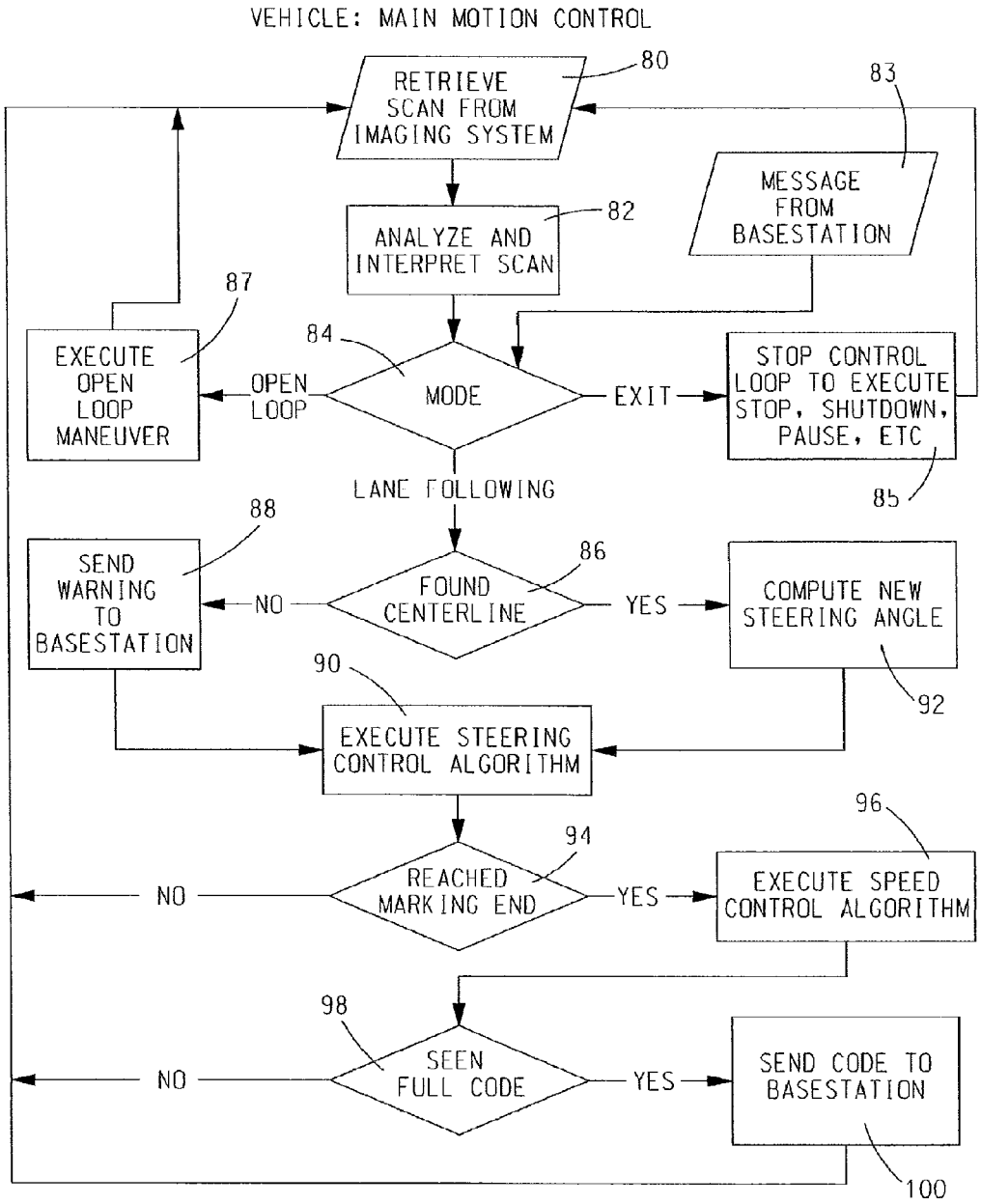
FIG. 18 is a flow chart showing the steps of a control algorithm implemented by the microcontroller of each vehicle.

2.2.5 Motion Control Flow Algorithm:

A high level flow chart describing the control algorithm implemented by microcontroller 40 of each vehicle 2 is shown in FIG. 18.

The control algorithm includes both steering and speed control and all the components necessary to gather the necessary information to correctly steer and move vehicle 2. Every cycle starts at step 82 by taking a scan using imaging system 3. In step 84, this scan from step 82 is analyzed and interpreted. If the scan is invalid, an error message may be sent to basestation 22 and vehicle 2 may use information from past scans to drive until a valid scan is recognized by microcontroller 40 or microcontroller 40 gets instructed otherwise by basestation 22. If the scan is valid, meaning it includes successfully-parsed road markings 12, in step 84, the next action for the vehicle is chosen based on this scan and the current state of vehicle 2.

In step 84, if vehicle 2 determines that the scan is invalid or if vehicle 2 cannot determine its next step, the algorithm advances to step 85 wherein execution of the algorithm is stopped and vehicle 2 executes a stop, shutdown, pause, etc. In contrast, if vehicle 2 is in a lane following mode, the algorithm advances to step 86 where microcontroller 40 computes the center of the center-line 10 in the scan and uses it to compute a new steering angle to center vehicle 2 over the road markings 12. Doing this consecutively for a number of road markings 12 causes the vehicle 2 to follow a path described by those road markings 12. If, in step 84, it is determined that vehicle 2 is in open loop mode, the algorithm advances to step 87 where microcontroller 40 executes an arbitrary trajectory commanded by basestation 22. Such trajectory can include lane changing, open loop turns, or anything else. As soon as the open loop maneuver has been executed, the algorithm will repeat steps 80-84 and enter into lane following mode by advancing to step 86. As shown in FIG. 18, a message from basestation 22 in step 83 can affect the mode vehicle 2 executes in step 84.

If, in step 86, microcontroller 40 determines that imaging system 3 has not identified center-line 10, the algorithm advances to step 88 where microcontroller 40 transmits a warning to basestation 22 via wireless network radio 42. Basestation 22 responds to this warning by transmitting steering control information to microcontroller 40 which advances to step 90 and executes steering control of vehicle 2 utilizing this information from basestation 22. On the other hand, if in step 86, microcontroller 40 determines that center-line 10 has been found, the algorithm advances to step 92 where a new steering angle is computed. The algorithm then advances to step 90 where microcontroller 40 executes the new steering angle. Thus, in step 90, microcontroller 40 can act on steering control information from basestation 22, or the steering angle determined by microcontroller 40 in step 92.

From step 90, the algorithm advances to step 94 where a determination is made whether imaging system 3 has reached the end of a marking 12. If not, the algorithm returns to step 80 as shown. On the other hand, if the end of a marking 12 has been reached, the algorithm advances to step 96 where microcontroller 40 executes the speed control algorithm discussed above.

The algorithm in FIG. 18 then advances to step 98 where microcontroller 40 determines if the full code represented by a single marking 12 has been seen. If not, the algorithm returns to step 80. On the other hand, if a full code represented by a single set of markings 12 has been seen, the algorithm advances to step 100 where microcontroller 40 sends the code (the location ID, the piece ID, or both) to basestation 22. Thereafter, the algorithm returns to step 80 as shown.

Depending on the last marking(s) 12 seen, microcontroller 40 can make higher level decisions. For example, after detecting a series of markings 12 describing a unique location on a road piece 6 of the drivable surface, microcontroller 40 can send this location information back to the basestation 22 to allow it to track the position of vehicle 2. Another example is determining from the markings 12 whether a road piece 6 is straight, or turns left or right, allowing vehicle 2 to steer to account for the expected road curvature without specifically having to communicate with basestation 22.

2.2.6 Secondary Control Software:

The vehicle control software can also manage several secondary tasks. For example, it can monitor the battery voltage of vehicle 2 and decides whether it is too low and notify basestation 22 or shut down operation of vehicle 2 in extreme cases.

The vehicle control software also includes a light module that controls the vehicle's LED headlights, turn signals and brake lights. The brightness of all LEDs is controlled by PWM (Pulse Width Modulation). The light module is an example of software with multiple control levels. In most cases, basestation 22 will interact with the light module like a driver using the light control in a real car. Basestation 22 can choose to use turn signals when turning, choose to turn on/off lights or high beams, while functions like brake lights work automatically whenever vehicle 2 slows down quickly (braking). Basestation 22 can also or alternatively take direct control over single lights and determine their state, like brightness, blinking frequency etc. This is not a realistic behavior, but is useful to suggest special messages to the user, for example when batteries are very low, the vehicle software is rebooting, during software updates, etc.

The vehicle software also includes a sound module that causes a PWM signal to be output to a speaker. The sound module can modulate various frequencies on top of each other to generate sounds ranging from simple beeping to realistic voices.

The vehicle software can also include a state module that keeps track of the last state of vehicle 2 and remembers the state even if vehicle 2 is turned off. This allows each vehicle 2 to maintain data and parameters like maximum speed, sound (such as honking or sirens), its unique identifier (such as a license plate), etc. without requiring changes to the vehicle software.

A bootloader can allow for wireless software updates to each vehicle 2. Basestation 22 can initiate a software update and transmit the new software to a specific vehicle 2 or to all vehicles 2 simultaneously.

3 Non-Vehicle Agents:

Non-vehicle agents can also exist in the system. These can include, without limitation, stop lights 8, railroad track crossings, draw bridges, building garages, etc. Each of these non-vehicle agents can share the same general operating and communications structure as the vehicles: namely, each non-vehicle agent can have a microcontroller operating under the control of software to execute logic and behaviors, and act as another node in the system's network. This allows each non-vehicle agent to be represented and reasoned about within basestation 22 as with all other vehicles 2 and agents.

Figure 19:
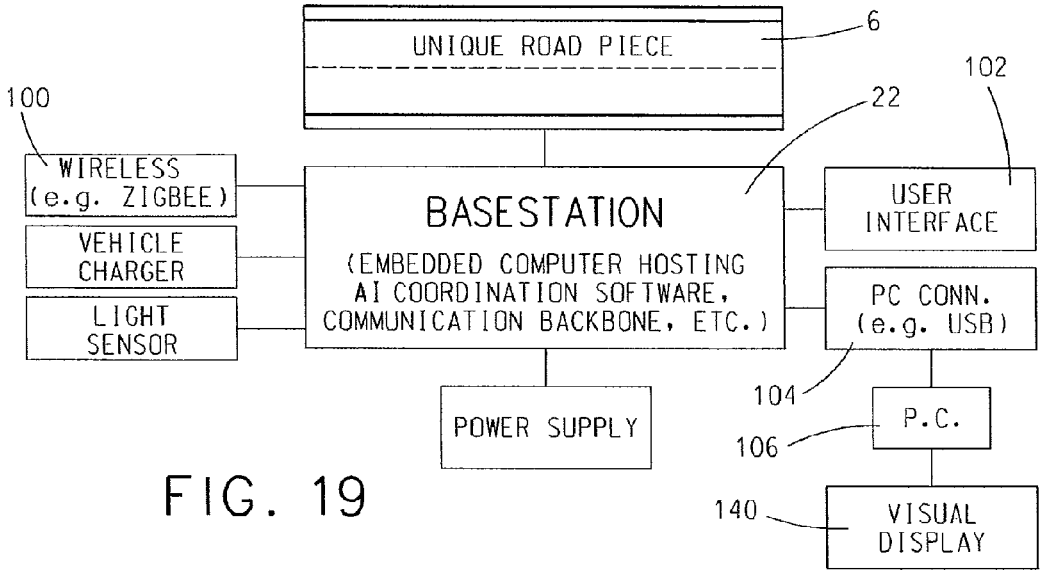
FIG. 19 is a block diagram of the basestation of FIG. 1 showing its interaction with various other possible components of the system.

4 Basestation:

With reference to FIG. 19, basestation 22 operates under the control of software to manage all high-level behaviors of the system. It maintains a virtual representation of the current system state, which basestation 22 updates according to a plan, e.g., without limitation regularly or periodically, as well as the state and intentions of each vehicle 2 and non-vehicle agent in the system. Additionally, it interprets commands from each user and relays these commands to the physical vehicle under the control of the user and/or other agents in the system. It also acts as a communication backbone coordinating all communications in the system: wireless to mobile agents like vehicles, wired to static agents like road pieces 6, traffic lights 8, etc. and also to an optional host PC (for example via USB). The role of basestation 22 within the system is shown in FIG. 19.

4.1 Hardware:

Next the core components of basestation 22 will now be described.

4.1.1 Embedded Computer:

Basestation 22 includes an embedded computer (controller) that hosts the main software including, without limitation AI software, communications software, etc. Desirably, the computer is a small embedded system, for example an Intel Atom, ARM9, etc., with enough memory and clock speed to handle the algorithms within the software and to scale to a reasonably large number of vehicles 2 and other agents. The computer may also host a real-time/near real-time operating system like embedded Linux, XWorks, QNX, uLinux or similar. The foregoing description, however, is not to be construed as limiting the invention since it is envisioned that basestation 22 can be implemented by any suitable and/or desirable combination of hardware, operating system, and software now known in the art (e.g., without limitation, a game console) or hereinafter developed that is/are capable of implementing the functions of basestation 22 described herein.

Like each vehicle 2, basestation 22 hosts a wireless module/transceiver 100 (for example ZigBee, Bluetooth, WiFi, SimpliciTI, or similar) to allow communication with each vehicle and/or agent, e.g., via the wireless network radio 42 of vehicle 2. The only difference is that basestation 22 is the communication coordinator, while vehicles 2 are the end devices.

4.1.2 User Interface:

Basestation 22 may have a simple user interface 102 that includes buttons and switches (not shown) for user input and LEDs and, optionally, an LCD screen (not shown) for feedback to the user. User interface 102 enables the user to control high-level functions. For example, if vehicle-based exploration is being utilized to detect the drivable surface, user interface 102 enables the user to cause basestation 22 to initialize this exploration. Another example would be a general start-stop interface to initialize or terminate operation.

4.1.3 PC Connection:

It is possible to connect basestation 22 to a PC or laptop 106 via a PC connection 104, such as a USB. In this case, the user can have more control over functions of the system as well as improved user feedback, for example, via a RoadViz visualization application described herein. Via the software on PC 106, the user can adjust various parameters of the system, such as, without limitation maximum vehicle speed, vehicle behaviors, drivable surface behaviors, etc.

4.2 Software:

4.2.1 Visualization Tool:

Basestation 22 communicates with a RoadViz visualization application that can run on PC 106 using a network interface (e.g., protocol TCP/IP or UDP/IP). Basestation 22 sends messages to the RoadViz visualization application that update the system state, such as, without limitation, the structure of the drivable surface and the vehicle positions and plans. The communications protocol described later herein details some example messages that are passed between basestation 22 and the RoadViz visualization application running on PC 106.

4.2.2 Vehicles and Agents:

Basestation 22 communicates with vehicles 2 and other agents using a wireless network (such as Zigbee or Bluetooth) or a wired network in the case of static agents, e.g., traffic light 8, connected to road pieces 6. Desirably, the wireless module/transceiver 100 is connected to basestation 22 using a standard RS-232 serial interface. An attention (AT) command set is used to send/receive messages to/from specific vehicles 2 and agents.

When a new vehicle 2 or agent is introduced to the system, it must register with basestation 22 so it can be modeled within the system and controlled. When the new vehicle 2 or agent is started, it will send a message to basestation 22. Basestation 22 can also send a broadcast message to the entire network to query all present vehicles 2 and agents (for example, during initialization). Desirably, a special identification system is used so that multiple basestations 22 can be used in proximity to each other, and vehicles 2 must choose to register with a specific Basestation 22. In any event, each vehicle 2 is a unique node in the communications network that has a unique address that allows basestation 22 to uniquely communicate with the vehicle 2.

4.2.3 Messaging Library:

Basestation 22 includes a software module that facilitates communication with vehicles 2 and other agents via wireless transceiver 100 and manages message processing and delivery. This software module has several components. The first component, serialComms, is used to read and write data to/from a serial port of basestation 22. This module provides functions that abstract the specific transport layer of communications. The second component, carComms, is used by basestation 22 to formulate and send messages to vehicles 2 and other agents. The module will also keep a message mailbox for each vehicle 2 and agent, and will process incoming messages and deliver them to the appropriate mailbox. The third component, carMessages, is used to instantiate the specific messages. These components provide basic storage and serialization capability. The carComms module will instantiate a message using carMessages, and then send it using the serialComms component.

4.2.4 Artificial Intelligence Algorithm:

All interactions and high-level behaviors of the system are governed by the algorithms expected by basestation 22. This includes where vehicles 2 want to drive, how they plan to get there, how they interact with other vehicles 2 on the drivable surface, whether they follow traffic rules, etc. Basestation 22 can control both physical and simulated agents. The only difference is that the objects in the system representing physical agents (e.g., vehicles 2 and agents, such as traffic signal 8), send and receive real messages, while simulated agents interact with a software layer that simulates the responses and location updates from a physical agent. Both appear identical to basestation 22, allowing complex hybrid simulations with combinations of real and simulated agents.

Desirably, while each vehicle 2 executes all behaviors, it only directly controls low-level behaviors such as speed control, maintaining headings within a lane, and transitioning laterally to adjacent lanes. All higher-level planning described is computed entirely within basestation 22 and relayed to vehicle 2 which executes these plans through a series of simpler behaviors.

Much of the behavior in the system is driven by randomness (vehicle destinations, some behaviors, etc.). Desirably, basestation 22 is able to reproduce behavior in a fully simulated system of agents by using a deterministic random number generator that runs off of a seed value. This seed value can be initialized to produce random behavior (from the system clock for example) or to a previously used seed value to perfectly replicate the behavior of the system during that run in order to investigate any problems that arose.

4.2.4.1 Road Piece Network Representation:

Before initiating normal operation, basestation 22 must have a representation of the drivable surface that is being used. This can either be read in from a file accessible to basestation 22 or determined by basestation 22 at run-time using one of the methods described above.

Figure 20:
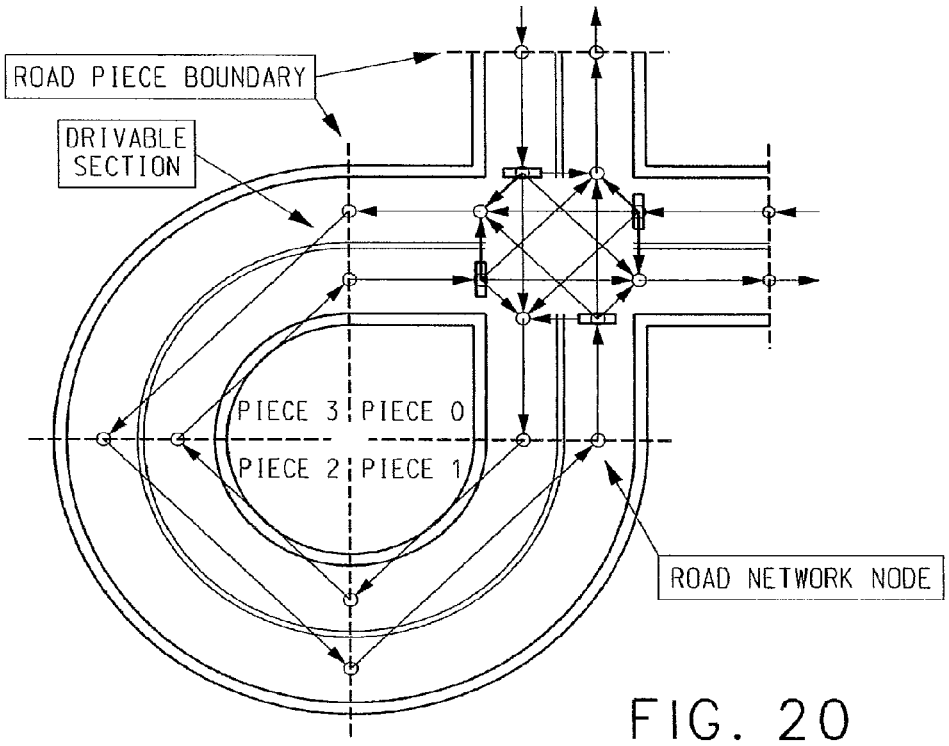
FIG. 20 is a view of a drivable surface that resides in a memory of the basestation.

With reference to FIG. 20, a virtual representation of the drivable surface is represented within basestation 22 as a directed graph that is used for planning purposes by all other vehicles 2 and/or agents in the system. The edges on this graph are known as drivable sections. Drivable sections are directed segments of a road piece that can be driven by a vehicle, and the nodes are points where one drivable section ends and one or more other drivable sections begin. For example, on a four-way intersection road piece, each entry to the intersection is a drivable section which then branches into four other drivable sections that lead to each possible intersection exit (right, straight, left, U-turn). These drivable sections represent higher-level flows of traffic, so even if there are multiple lanes on a road piece, all the lanes in each direction of traffic would be represented by one drivable section. A larger example of a drivable surface is shown in FIG. 21.

Along with a representation of the system state (such as drivable surface structure), each vehicle 2 and each static agent (such as traffic light 8) is represented in the virtual representation as an object that includes all information relevant to that agent. At specified frequencies, each vehicle 2 and/or static agent is presented by basestation 22 with the relevant information regarding the state of the rest of the system and told to update basestation 22 with its state, in effect making a decision concerning its behavior for the next time step (time period). This structure allows the processing for vehicles 2 and/or static agents to be parallelized across multiple threads, if desired.

4.2.4.2 Global Planning Algorithm:

A global planning algorithm is the core of basestation 22. All vehicle behavior is handled by modules that are called the global planner and the local planner. The global planner is responsible for high-level, long-term decisions such as determining the series of drivable road pieces 6 that need to be traversed in order to reach some destination in the drivable surface. For example, it might determine that the most efficient way for vehicle 2 to get from one point to another would be to take a U-turn followed by a left turn at the next intersection. The global planner abstracts away all local complexity such as lane changing, signaling, speed control and interactions with other vehicles and only considers the problem at the global scale.

While in many path planning applications a grid might be used to search for paths (where each square is connected to all its neighbors, representing possible motions), the present system has additional structure in the form of drivable sections (road pieces 6) that it can take advantage of to perform effective planning at a higher level. The global planner computes global paths by operating on the directed graph structure described earlier. Each edge in the graph includes a cost for traversing that drivable section. That cost is a function of various parameters such as length, maximum speed, number of lanes, and the presence of stop signs and lights, and could be customized for each such agent depending on their priorities. The global planner uses this weighted, directed graph to compute optimal paths using a graph search algorithm such as the A* or Dijkstra's algorithm.

The difference between A* and Dijkstra's algorithm is that A* uses a heuristic function that estimates the total cost from any state to the goal to guide the direction of the search. Since a reasonable estimate can be made for this cost from any state, A* is more desirable for this application. The A* algorithm traverses various paths from start to goal and for each node x, it maintains three values:

g(x): the smallest path cost found from the start node to node x;

h(x): the heuristic cost from node x to the goal; and f(x)=g(x)+h(x)=the estimated cost of the cheapest solution through node x;

Starting with the initial node, A* maintains a priority queue of nodes to be explored, known as the open set, sorted in order of increasing value of f(x). At each step, the node with the lowest f(x) value is removed from the queue to be evaluated (since the goal is to find the cheapest solution), the g and f values of its neighbors are updated to reflect the new information found, and those neighbors are added to the open set if they had not been previously evaluated or if their f values have decreased from previous evaluation, representing a possibility of a better path through that node. In effect, the A* algorithm searches in the direction which appears to be best, often resulting in the optimal path with a much smaller amount of work compared to a brute-force search.

A heuristic is considered admissible if it is guaranteed not to over-estimate the true cost to the goal. In such a two-dimensional path planning example, if the cost of a path were equal to the distance, the simplest admissible heuristic is the straight-line distance to the goal. With an admissible heuristic, once a path to the goal is found whose cost is lower than the best f(x) on the priority queue, it is guaranteed to be the optimal, lowest-cost path. Dijkstra's algorithm is equivalent to a special case of A* where h(x)=0 for all states.

For a simple example of A* search, see FIGS. 22A-25. Here, the goal is to find the lowest cost path from node A to node D where the cost of an edge is simply its distance and the heuristic function h is the straight-line distance to the goal node.

Figures 22A, 22B:
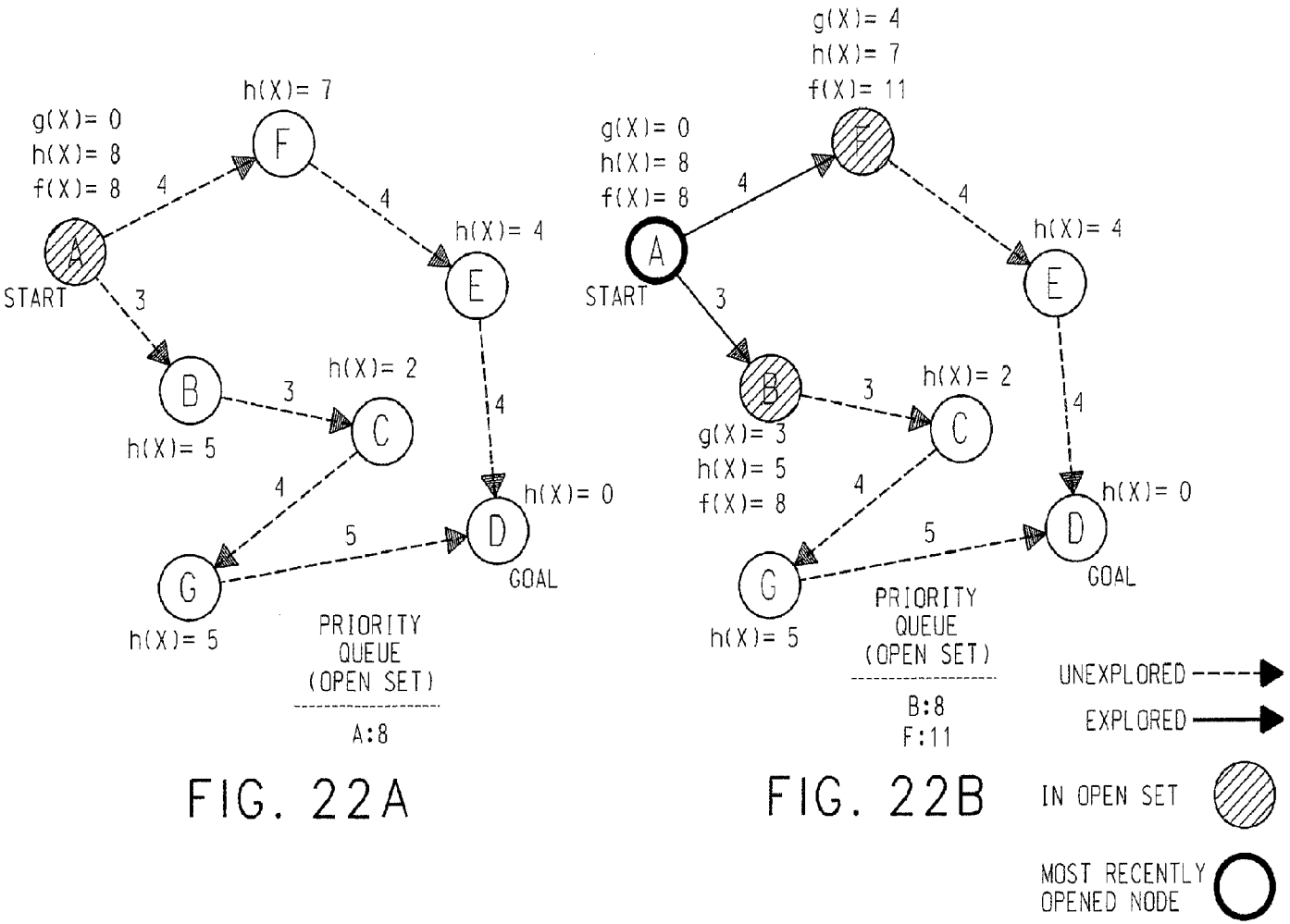

With reference to FIG. 22A, a start node A is inserted into the open set with optimistic total cost estimate of "8". In FIG. 22B, node A is removed from the priority queue and the cost of A's neighbors, B and F, are updated and those nodes are added to the open set. Each node's priority value on the open set is equal to its value of (f), the sum of the best path from node A to that node (g), plus the heuristic cost from that node to the goal (h).

Figures 23A, 23B:
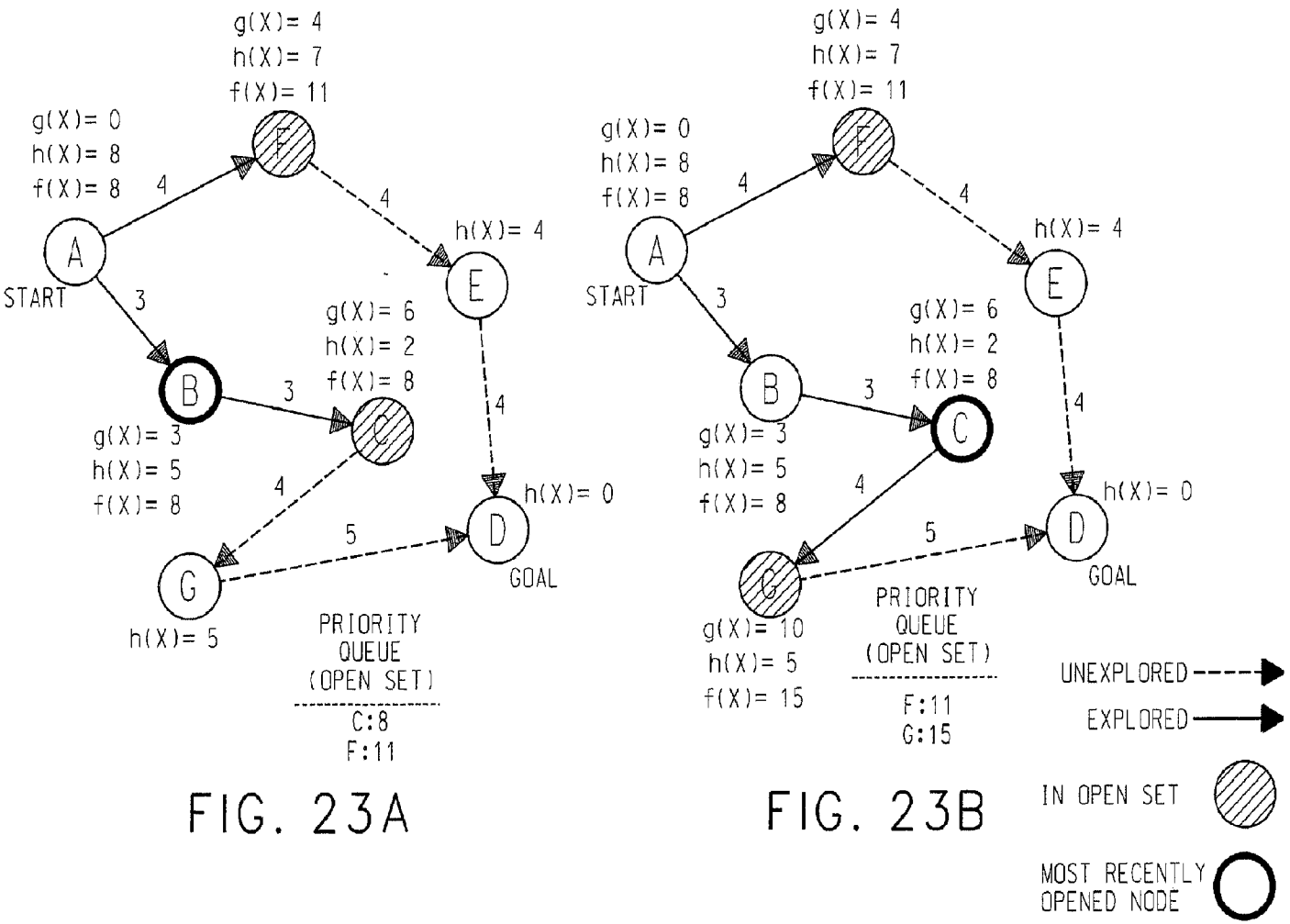

In FIG. 23A, the lowest-estimate node in the open set is removed from the priority queue, the cost of B's neighbor C is updated, and C is added to the open set. In FIG. 23B, node C is removed from the priority queue and its neighbor node G is added to the open set.

Figures 24A, 24B:
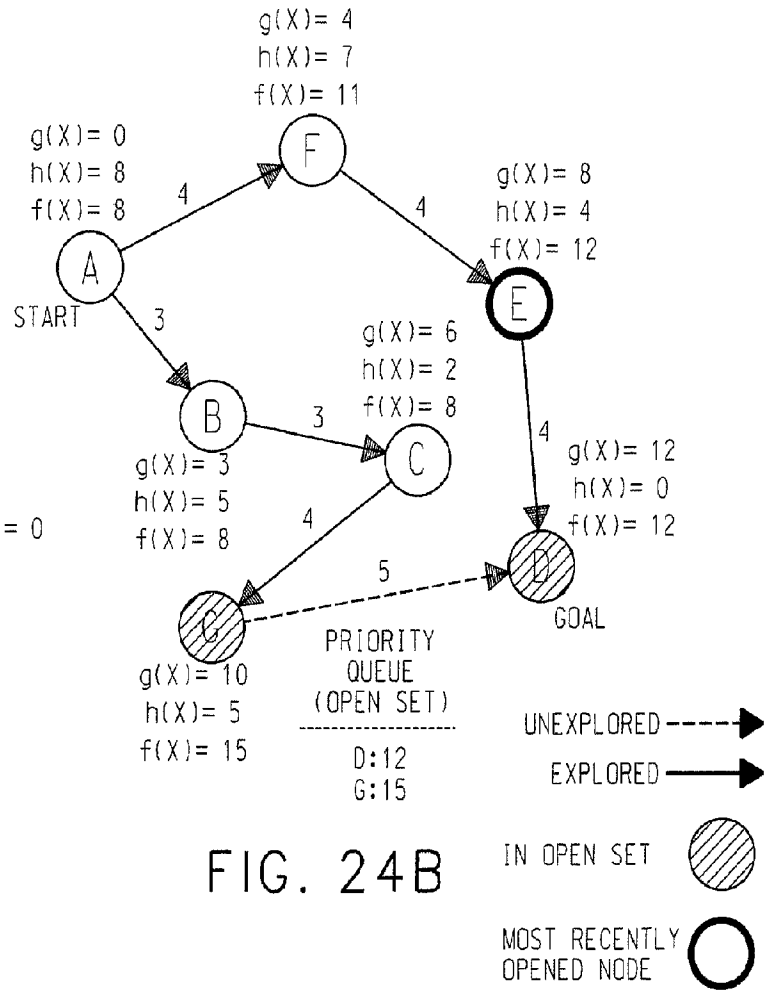

In FIG. 24A, node F, the lowest-cost node on the open set, is removed from the priority queue and its neighbor E is added to the open list with its newly computed value for (f). In FIG. 24B, node E is removed from the priority queue and its neighbor node D is added to the open list.

Figure 25:
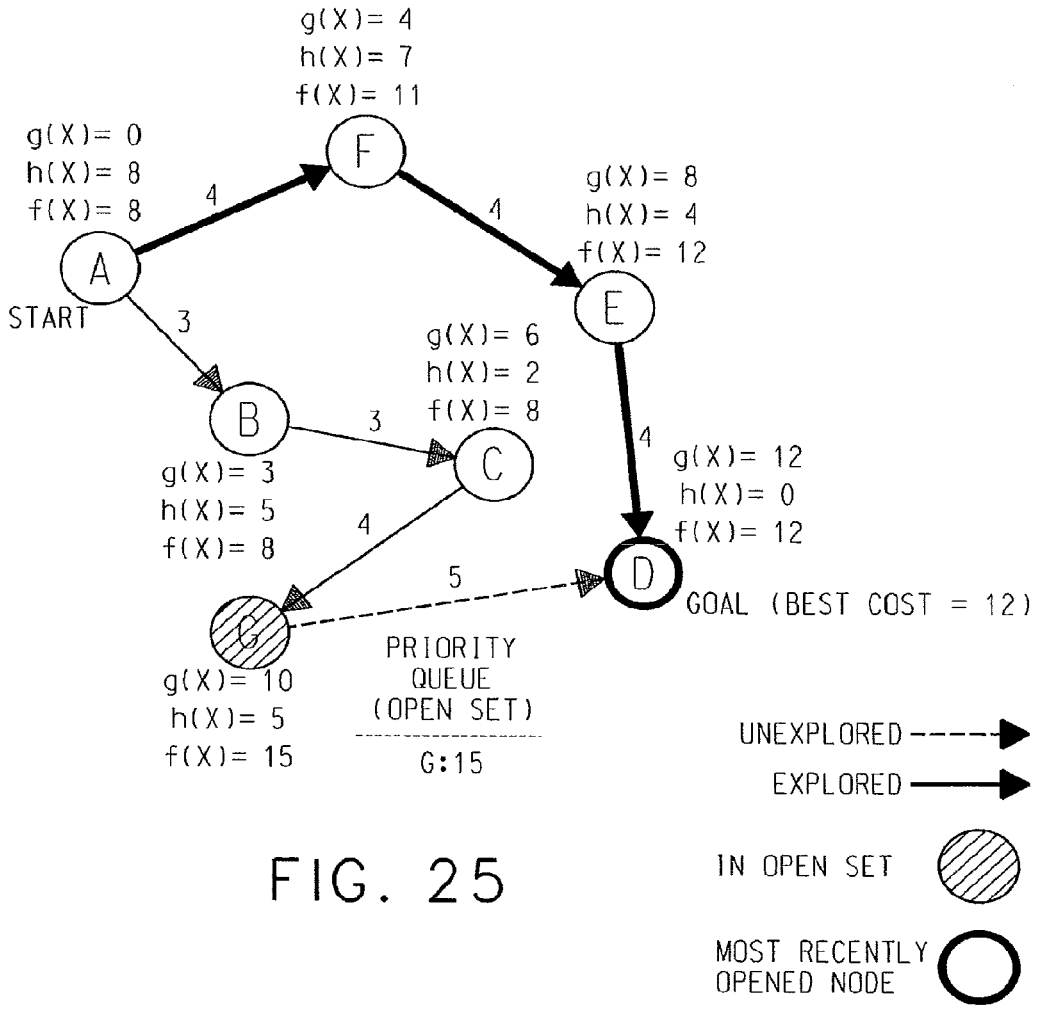

In FIG. 25, the goal node, node D, is removed from the open set. The total cost of the best found path at this path is 12, i.e., the path comprising nodes A, F, E, and D. Node G is still in the open set. If node G has a value of (f) that is less than the current best path cost, namely 12, searching would continue as there is still a potential for a better path to the goal than the one already found. However, since the optimistic path of the path from node A to node D via node G has a value of (f) of 15, which is greater than 12, it is known that the optimal path has been found and the search is finished. In FIG. 25, the optimal path is shown as a series of thick arrows.

A* can easily be extended to search to a set of goal nodes rather than a single goal node by adjusting the heuristic function to estimate the optimistic cost to any goal node. Also, while the example of FIGS. 22A-25 shows a search over a relatively small graph with limited nodes and only two dimensions (2-dimensional coordinates), A* is often used for much higher-dimensional search problems where additional dimensions can represent additional aspects of the vehicle state such as speed and time. This allows planning with more realistic motions and accounting for moving obstacles. These extensions can be taken advantage of during local planning, described next.

4.2.4.3 Local Planning Algorithm:

Basestation 22 includes a local planning algorithm that executes the steps that enable vehicles 2 to execute a global plan. This includes speed control, distance keeping with other vehicles, lane changing decisions, behaviors at intersections, and signaling. For realism and scalability, decisions for vehicles 2 are made using only local knowledge rather than with full knowledge of the system to mirror real-world logic and allow the complexity of the system to scale with many vehicles 2 in a tractable way. For example, an object representing a vehicle 2 has full knowledge of its own state and plan but cannot use other vehicles' 2 plans in making its decision. It only has access to aspects of the system state that would be visible in the respective real-world scenario (locations and speeds of nearby vehicles 2, the state of traffic lights 8, etc.).

Figure 26:
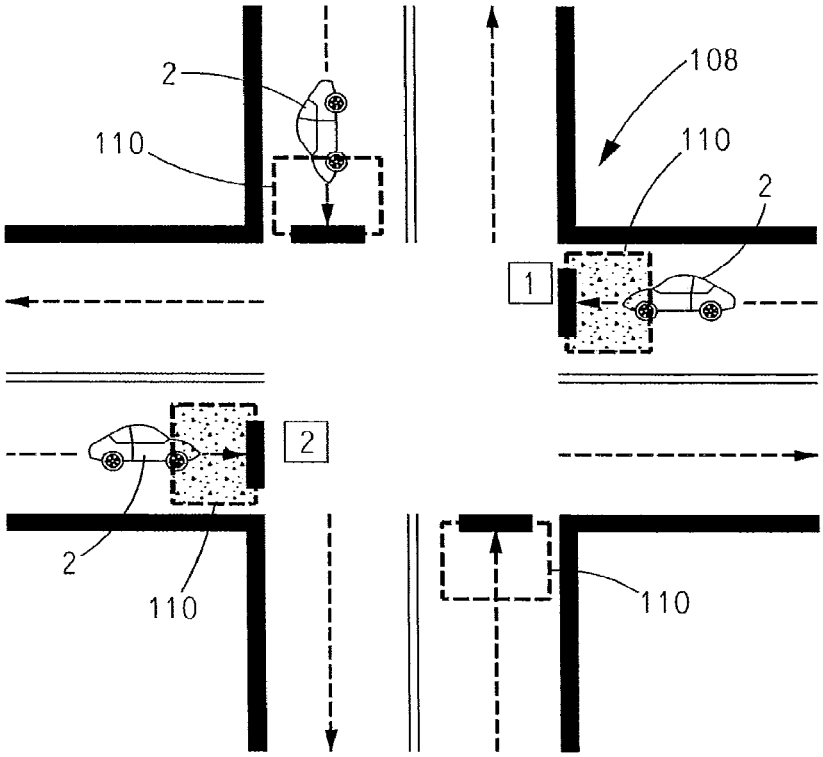
FIG. 26 is an illustration of an intersection object that is stored in a memory of the basestation showing left and right entry points occupied where the vehicle driving from the right has first priority to advance due to its earlier arrival time.

4.2.4.3.1 Intersection Behavior:

With reference to FIG. 26, for more effective structure and computational efficiency, each intersection 108 is also represented as an object within basestation 22 that tracks its own state and the state(s) of vehicle(s) 2 currently interacting with it. Each time basestation 22 updates the state of objects in the system, the intersection 108 object identifies which of its entry points 110 (shown by dashed boxes in FIG. 26) are occupied by vehicles 2. The intersection object tracks the time when each vehicle 2 entered each of the intersection's entry points 110 and determines when it is a vehicle's 2 turn to advance. For example, at a four-way stop sign, a vehicle 2 may be identified as able to advance if it has the earliest arrival of all vehicles 2 at the intersection 108, the intersection interior is clear of other vehicles 2 and it has been static for some minimum amount of time. At intersections that have traffic lights 8 or stop signs on only a subset of its entry points, the current motions of relevant vehicles 2 can be considered in determining clearance to proceed. When a vehicle 2 is at an intersection 108 and wants to advance, it will only do so if the intersection object determines it is proper to advance.

Figure 27:
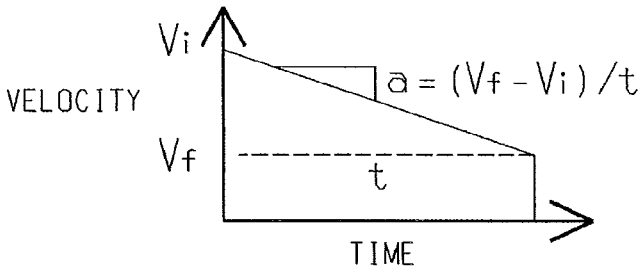
FIG. 27 is a graph showing relationship between time, velocity, acceleration, and distance during a speed change.

4.2.4.3.2 Speed Control:

The speed-related high-level computations by basestation 22 desirably assume a fixed acceleration and, therefore, use the simple model illustrated in FIG. 27.

Here a vehicle changes from an initial velocity $V_i$ to a final velocity $V_f$ over time t with an acceleration of a. The distance, d, over which this speed change will take place can be determined by integrating the area under this function as follows:

$$d = \int V dt = t * \min(V_i, V_f) + \frac{t * |V_i - V_f|}{2}$$

$$t = \frac{|V_i - V_f|}{a}$$

There are numerous scenarios when a variable needs to be computed and other variables are known. For example, if it is desired to stop from an initial velocity $V_i$ over time t, an acceleration of $$a = \frac{V_i}{d}$$

is required.

Figures 28A, 28B:
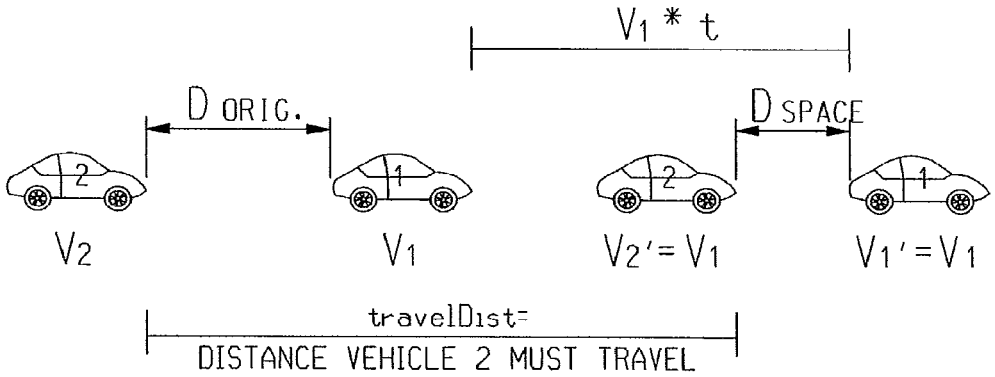
FIGS. 28A and 28B are illustrations related to a distance keeping computation performed by the basestation to maintain a safe distance between moving vehicles.
Figure 29:
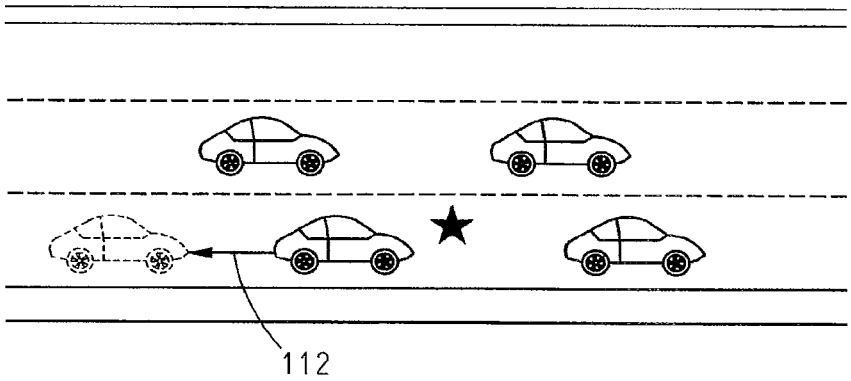
FIGS. 29-32 are illustrations of local planning by the basestation to find a series of actions and resulting states to allow a vehicle trapped in a lane by several other vehicles to pass said vehicles.
Figure 30:
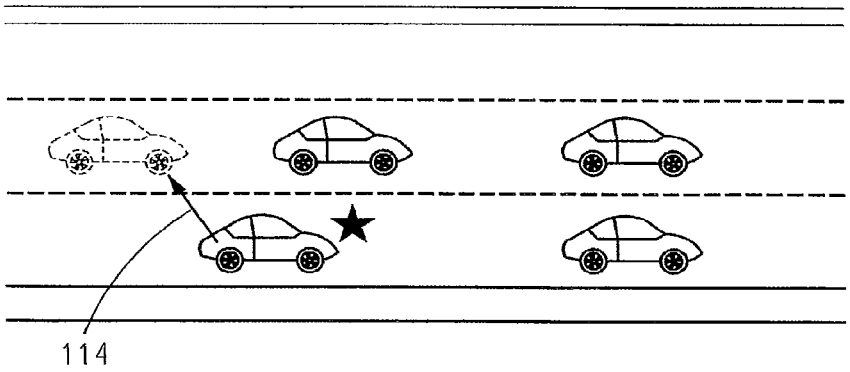
Figure 31:
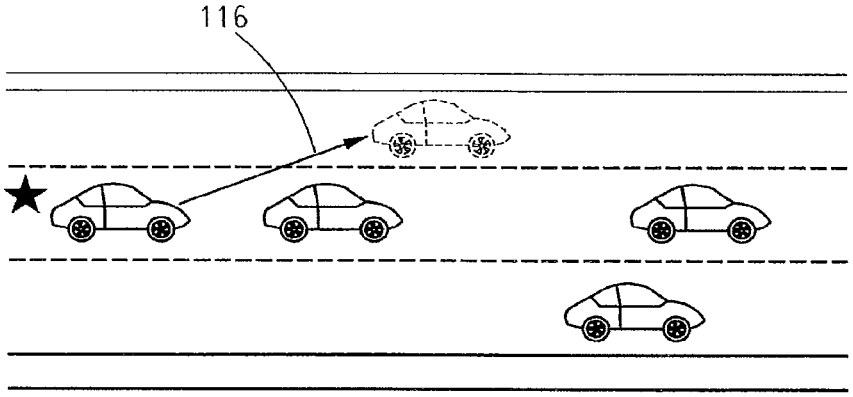
Figure 32:
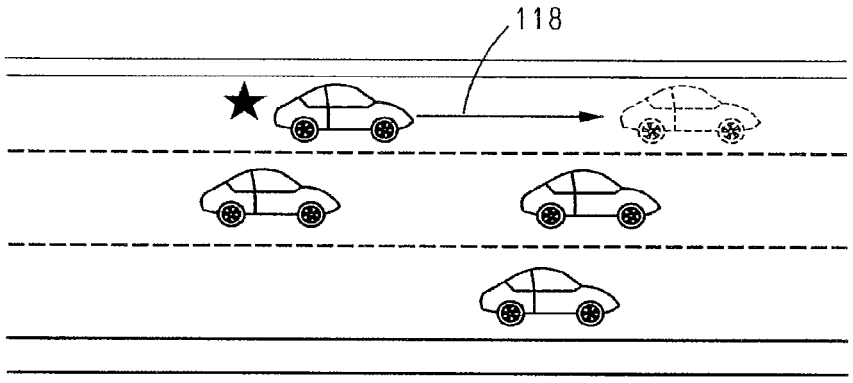

With reference to FIG. 28, a more complex problem is for a vehicle $V_2$ to maintain a safe distance behind a vehicle $V_1$ ahead of it. Trailing vehicle $V_2$ accomplishes this by trying to match the speed of leading vehicle $V_1$ at a follow distance of $D_{space}$ which is a safe follow distance that is a function of factors such as the road speed limit and the speed of the leading vehicle, $V_1$. Vehicle $V_1$'s motion is simulated forward for time t, assuming it keeps its original speed. Vehicle $V_2$ must, therefore, compute the acceleration a that allows it to transition from its original speed $V_i$ to a final speed $V_f$ over a distance of travelDist:

$$travelDist = t * \left(V_f + \frac{|V_i - V_f|}{2}\right)$$

$$travelDist = \frac{|V_i - V_f|}{a} * \left(V_f + \frac{|V_i - V_f|}{2}\right)$$

$$a = \frac{|V_i - V_f|}{travelDist} * \left(V_f + \frac{|V_i - V_f|}{2}\right)$$

When this is executed at a relatively high frequency for each vehicle 2, basestation 22 is able to achieve smooth and realistic distance keeping in complex traffic systems through this computationally efficient and decentralized approach.

The same computation can be used to achieve a speed change such as stopping at a specific location: the vehicle 2 can compute the acceleration a that allows it to transition from its original speed $V_i$ to a final speed $V_f$=0 over a remaining distance. However, due to communication delays, uncertainty of positioning and unpredictable speed changes due to traffic and other conditions, speed change commands within basestation 22 and vehicles 2 are specified relative to absolute locations identified by position markings 12 rather than commanded for immediate execution. For example, to stop at a stop sign or the end of a path, a vehicle 2 would be sent a command by basestation 22 to achieve a speed of 0 with a certain deceleration at an offset from some location markings 12 encountered earlier. Having an absolute location to track its position from, as vehicle 2 approaches the desired stopping point vehicle 2 will continually recompute travelDist, the distance required to achieve the target velocity at the specified acceleration, and will begin executing the speed change when travelDist is equal to the remaining distance to the destination. In this way vehicle 2 is able to execute a realistic stop at stop signs regardless of the traffic conditions in which it is driving.

4.2.4.3.3 Full Local Planning with Lane Changing:

The full local planning algorithm implemented by basestation 22, that includes speed and lane changing decisions, can be treated as a multi-dimensional planning problem rather than planning in a two-dimensional, position-based search space, as in the case of the global planning algorithm. One desirable approach used by basestation 22 is to treat this problem as a planning problem in four dimensions:

- Lane: The lane position on a road piece 6. This is desirably an integer number having a value that is small for the street version of the system (since lanes are spaced apart) and desirably in the low double digits for the racing version of the system since lanes are more numerous and tightly spaced representing more continuous possible lateral positions.
- Forward distance: The forward distance from a starting location until some planning horizon. This can be discretized at some relevant resolution, for example, by road marking 12 locations.
- Speed: The speed of the vehicle. Initial speed is the current vehicle speed which can change at some specified rate.
- Time: Time starting at 0, the current instant in time. This is important since there are other moving vehicles 2 on the drivable surface that change positions and must be accounted for.

These dimensions form the search space where a point in this space corresponds to a state, i.e., some value for each of the dimensions mentioned above. Each point in this space connects to other points in this space representing states that are reachable from the state after some action. For example, a point in this space may have a connection to another point representing adjacent lanes forward in distance and time relative to its speed, but not to points representing lanes far away or times in the past (since these transitions are not possible). So in effect, this forms a graph search problem as with the global planning algorithm, except that the search space and branching factor are significantly larger. In fact, while there are a large number of possible states based on these four dimensions, only a relatively small subset of them are relevant for the search problem. The planning horizon, or how far into the future distance basestation 22 computes plans, is defined by the maximum value for the forward distance dimension under consideration. This is a trade-off between computational complexity (since a larger forward distance increases the size of the graph to be searched) and plan effectiveness (the need to plan sufficiently far into the future to generate intelligent plans).

One assumption to make for short planning windows concerning the paths of other vehicles 2 is that these other vehicles 2 will maintain their current speed and lane unless they are signaling otherwise. It is also possible to incorporate uncertainty about the motions of other vehicles 2 by penalizing states that have some potential to be affected by those vehicles 2. While the local plan is computed by basestation 22 far enough into the future to identify sophisticated behaviors, the local plan will be recomputed frequently, allowing basestation 22 to react to any deviations from the assumed behavior of vehicles 2.

Basestation 22 solves this multi-dimensional planning problem by planning from the starting point in this space to any point at the planning horizon (all nodes with the specified forward distance dimension value are considered goal states) subject to some optimization function. Such a function could, for example, penalize lane or speed changes and closer encounters with moving obstacles, and reward higher speeds, progress towards a goal or being positioned in a specific lane if a turn is planned in the future. The function being optimized captures the current goal of the vehicle 2, and the goal of basestation 22 is to find a series of allowable actions through this high dimensional space that optimizes the value accrued from this function.

As mentioned previously, while this multi-dimensional state space can be large and difficult to fully represent in a memory of basestation 22, the entire space does not need to be represented since most states will never be considered. One desirable, non-limiting, implementation can allocate space for new states only as they are considered, reducing the memory requirement to only the relevant fraction of the full state space.

Basestation 22 can use optimal algorithms, such as A* or Dijkstra's, or can utilize sampling based probabilistic approaches such as Rapidly-Exploring Random Trees (RRTs) biased towards the planning horizon since plans do not need to be optimal and the search space may be too large. In such approaches, the aspects of the state space no longer need to be discretized at a specific resolution since sampling techniques can operate on arbitrary locations in the state space.

Another option is to utilize a special version of A* called Anytime Repairing A* (ARA*).ARA* has the property that it will first quickly find a sub-optimal solution to the planning problem and will spend the remaining time iteratively improving it as time permits. ARA* accomplishes this by repeatedly calling the normal A* algorithm but multiplying the values returned by the heuristic function by some constant $\epsilon$>1. This new heuristic is no longer admissible (since it may overestimate the true cost to the goal from any state), but it reduces the search time significantly since fewer states will appear to have a possibility of contributing to the path. Even though the final solution will no longer be optimal, it is guaranteed to have a cost at most $\epsilon$ times larger than the true optimal cost and in practice is often much closer to the optimal. By gradually reducing $\epsilon$ and intelligently reusing much of previous iterations' computations, ARA* has the desirable property that a reasonable solution, often close to the optimal, will always be available within the fixed time that the algorithm has to operate. This allows basestation 22 to compute high-quality plans while guaranteeing that its required update frequencies will be met.

Figure 33:
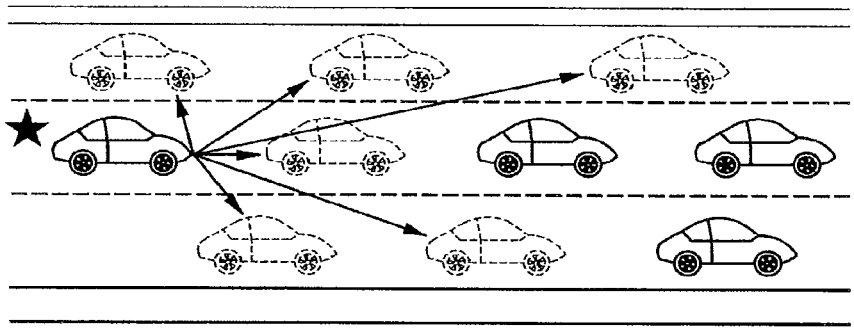
FIG. 33 shows the sampling of possible future states that are possible from the state depicted in FIG. 31 for the passing vehicle by varying the passing vehicle's speed or lane.

To better understand the purpose of this local planning by basestation 22 and the types of plans that may be found by such an approach, consider the example plan shown in FIGS. 29-33. Here the vehicle 2 with the star next to it has a high importance on reaching its destination as quickly as possible but finds itself pinned in the right lane by several other vehicles 2 going at a moderate speed. A naïve plan would be to stay in the current lane and keep as short of a distance as possible to the vehicle 2 in front of it as that is the instantaneously optimal behavior. Given the objective function for this vehicle 2 with the star next to it, however, local planning by basestation 22 is able to find a series of actions and resulting states that allow said vehicle 2 to escape from the right lane by first slowing down (as shown by arrow 112 in FIG. 29) to let the other vehicles 2 pass and then shifting through the opening to the left lane that is unoccupied, as shown by arrows 114, 116, and 118 in FIGS. 30-32, respectively. While FIGS. 29-32 only show an example sequence of selected states, each state branches into many other states that were not chosen. FIG. 33 shows a sampling of such future states that are possible from the state depicted in FIG. 31 by varying the vehicle's speed or lane. A good heuristic to guide the search can overcome such large branching factors while still finding acceptable plans for a sufficient planning horizon by first exploring the options that are most likely to have good outcomes.

4.2.4.3.4 Other Logic:

Additional logic within basestation 22 controls behaviors such as logic for traffic light 8 signaling and execution of sounds. Intended behavior is communicated by basestation 22 via messages to the physical agents for execution.

Figure 34:
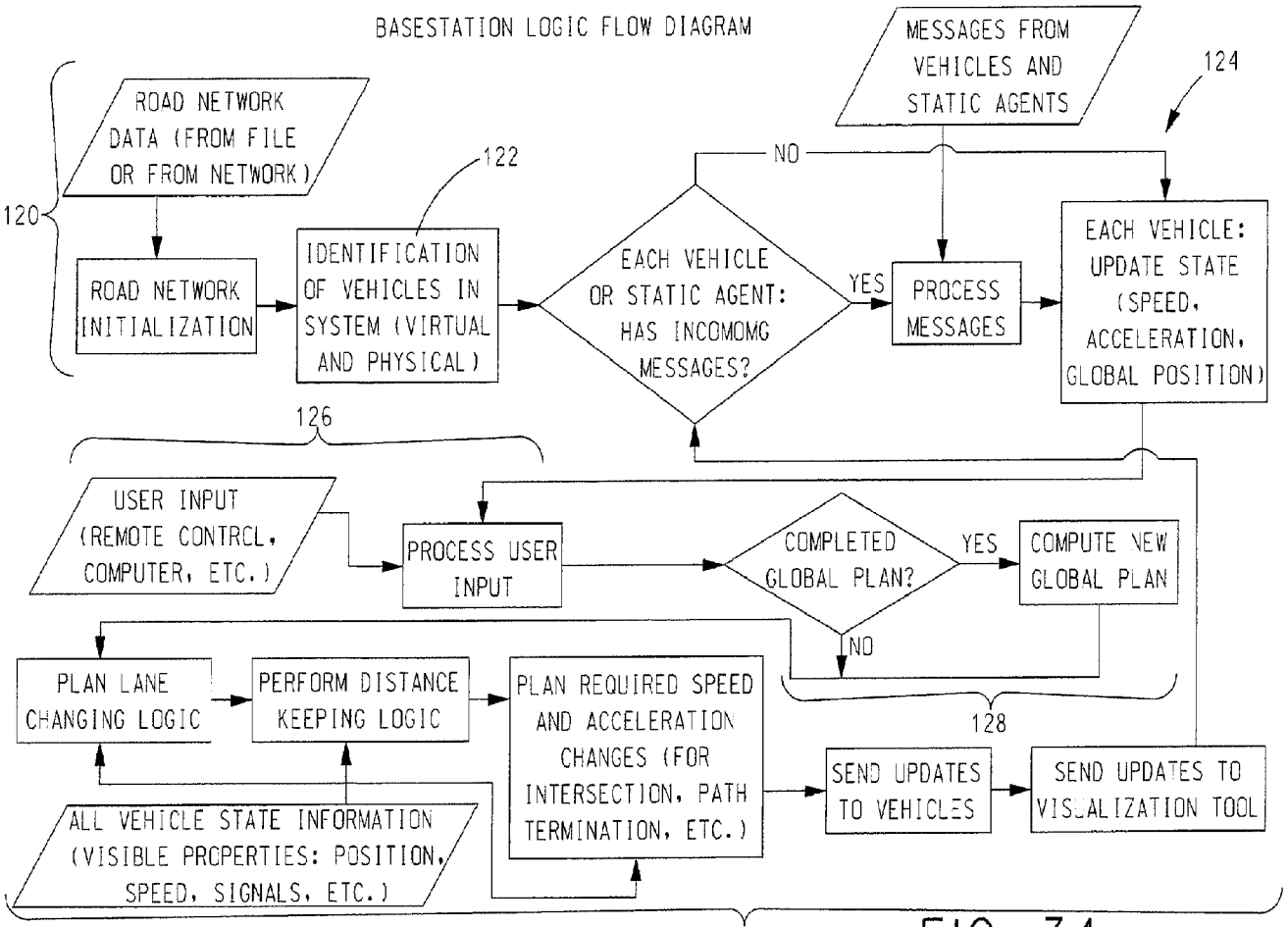
FIG. 34 is a flow chart showing the steps of a control algorithm implemented by the basestation.

4.2.5 Basestation Software Summary:

A flow diagram explaining possible logic in basestation 22 at a high level is shown in FIG. 34. Knowledge of the drivable surface is first initialized 120, followed by identification 122 of all vehicles 2 in the network. Next begins the main basestation loop 124 that first checks for any incoming messages, processes them for each vehicle, and updates the vehicles' states such as their speeds and positions in the network. After any user input from connected remote controls or computers is processed at 126, the system checks on the state of the current global plan 128 for each vehicle 2. If it has been completed, a new one may be computed as necessary. Following the global plan update 128 is a local plan update 130 for each vehicle 2. This includes logic that governs lane changing, distance keeping, intersection logic, speed changes, signaling updates, etc. Once all planning updates have been made, necessary updates are sent to each vehicle in the network as well as the road visualization tool if one is available.

5 User Interface:

Vehicles 2 can be controlled by basestation 22 or by a user, for example, via a remote control 132. A user's main interaction tools with the system is a remote control 132, a PC 106 connected to basestation 22, or both a remote control 132 and a PC 106.

5.1 Remote Control:

Each remote control 132 includes a wireless transceiver (not shown) which is part of the system's wireless network. As with vehicles 2, there can be many remote controls 132 interacting with the basestation 22 and vehicles 2 simultaneously. In the most common case, each remote control 132 is used by a user to control a specific vehicle 2. What vehicle 2 is being controlled can be changed at any time by the user. When the user switches control away from one vehicle 2, basestation 22 resumes full control over that vehicle 2. All vehicles 2 not controlled by a remote control 132 are automatically controlled by basestation 22. Compared to common remote controlled toy cars, the remote controls 132 described herein offer a higher level of interaction. The steering itself is desirably performed by the vehicle 2 and not by the user, since vehicles 2 can move quickly and the roads can be narrow. A user can instead provide higher level commands to a vehicle 2 in the form of speed adjustments, deciding to switch lanes, deciding where to turn at intersections, initiate U-turns, pass other vehicles 2, etc. Also, a user can have control over secondary vehicle functions like turning signals, lights, honking, etc.

Figure 35A:
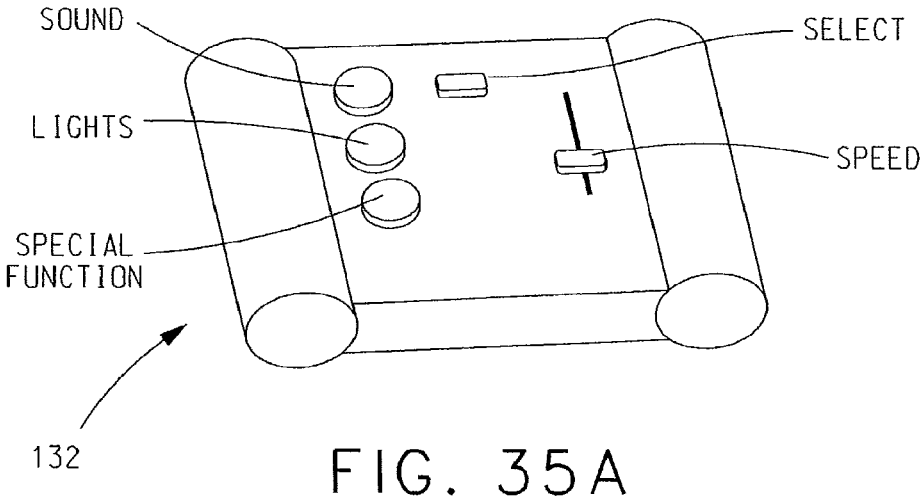
FIGS. 35A and 35B are perspective views of the exemplary remote control shown in block diagram form in FIG. 1.
Figure 35B:
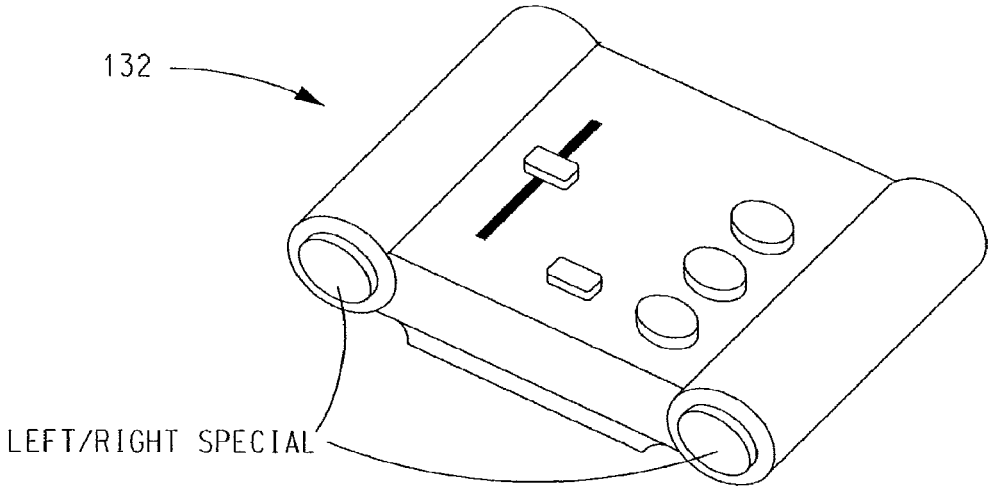

FIGS. 35A-35B show an exemplary design of a remote control 132. The front middle (select) button allows a user to cycle between vehicles.

Figure 36B:
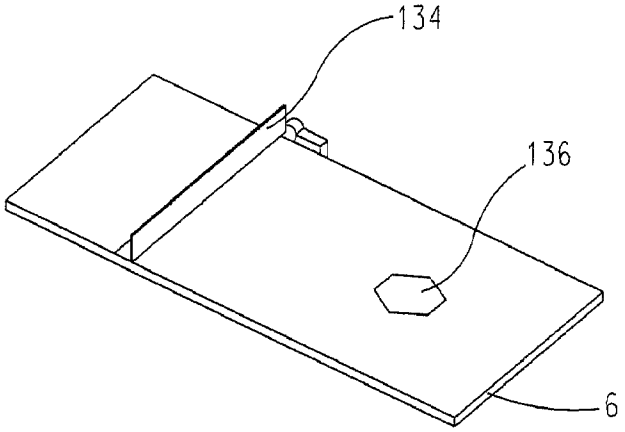
FIGS. 36A and 36B are examples of a road piece that include a vehicle-activated trap for use with a racing mode of the present invention.
Figure 36A:
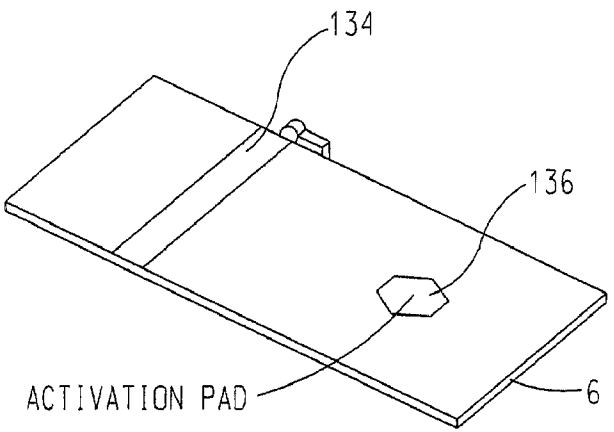

In addition to controlling vehicles, remote controls 132 can also be used to control stationary agents, such as the special components: traps on road pieces, traffic lights 8, road barriers, garage doors, etc. FIGS. 36A-36B show an example of a stationary agent, namely, a trap 134 on a road piece 6 that is used in a racing mode. In this case, trap 134 is assigned by basestation 22 to the first vehicle 2 which drives over a hexagon 136. The driver then has control over trap 134 and can arm it at any time using remote control 132. In this case, trap 134 will elevate a wall 138 mounted in the road piece 6 to block the way for following vehicles 2 for a certain amount of time. Purely virtual traps are also possible. For example, when a vehicle 2 drives over a certain part of the road, it may only be able to drive at half of its maximum speed for some time. There are a large number of real and virtual traps 134 which can be designed in a similar way and can be armed and controlled both by users with remote controls 132 as well as by basestation 22.

5.2 PC Control:

The controls described above in connection with remote control 132 can also or alternatively be replicated through PC 106 using a keyboard, a mouse and/or an attached gamepad. Additionally, this allows the possibility of an operator commanding a vehicle over the internet using a visualization of the system state.

Figure 37:
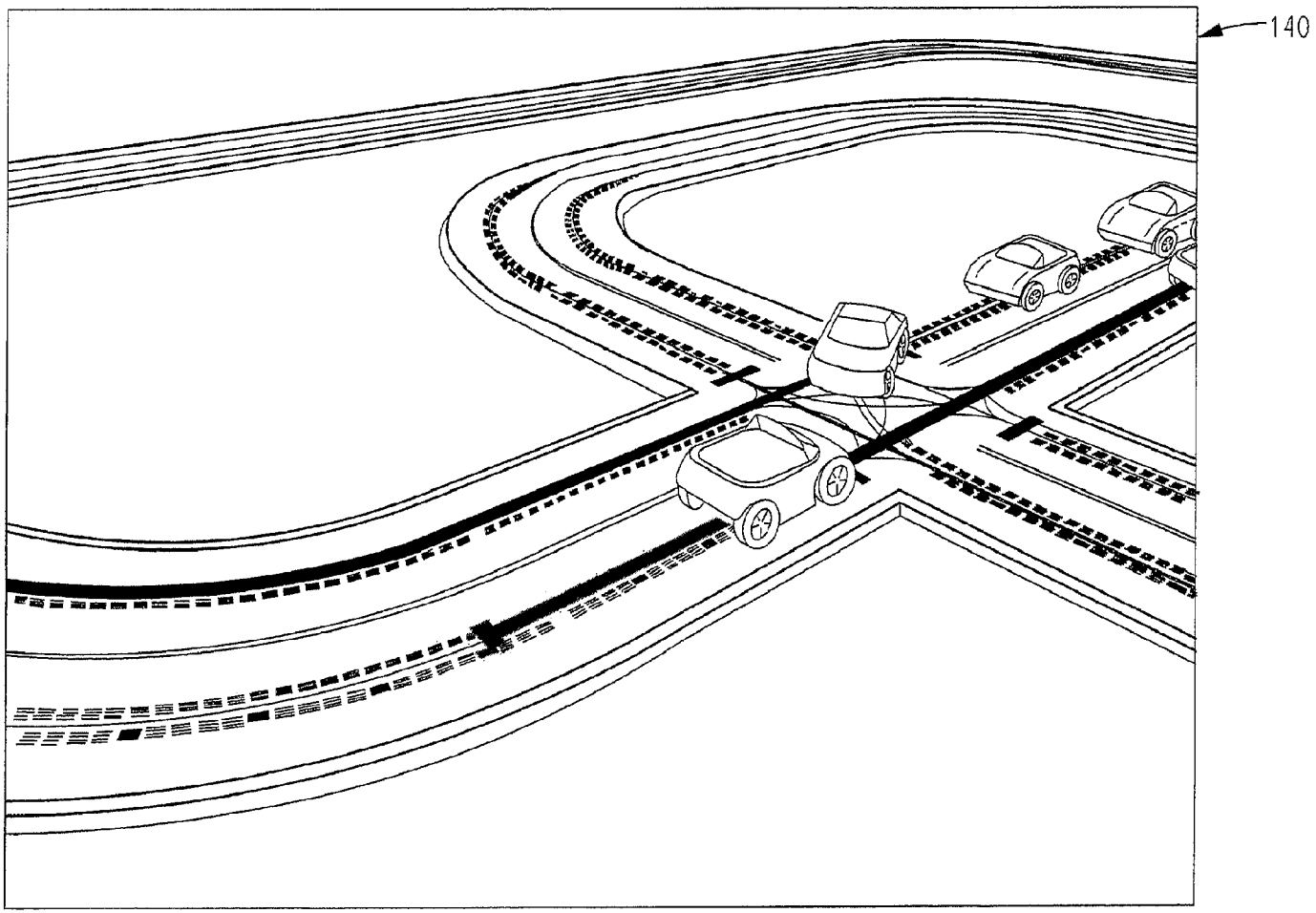
FIG. 37 is a perspective view of a visualization software that runs on a personal computer (PC) of FIG. 19 to display the system state on a visual display (also shown in FIG. 19)

6 Visualization Software:

With reference to FIG. 37, desirably the RoadViz visualization application is provided on PC 106 that can visualize the system state in basestation 22 and cause basestation 22 to display the system state on a visual display 140 connected, for example, to PC 106, shown in FIG. 19. The system state includes all the information necessary to visualize and manage the system and its agents. This includes items such as road pieces 6 and their locations, vehicle 2 positions and velocities, and the state of static agents (e.g., whether a traffic light 8 is green, yellow, red). The visualization application can monitor the basestation's 22 understanding of the system and is useful for running test simulations of the software modules.

6.1 Components:

6.1.1 Graphics Engine:

Desirably, the visualization application uses a 3D graphics engine. One implementation can be built using C# and the Microsoft XNA platform. Via the visualization application, the user can control a virtual camera to view the network at a desired location. An example screenshot on visual display 140 is shown in FIG. 37.

6.1.2 Software Structure:

The visualization application desirably uses several threads to distribute its computational load. One application thread is dedicated to rendering the graphics, and another thread is for network communications with basestation 22.

6.1.3 Communications:

The visualization application desirably uses a network socket communications (such as TCP/IP) and acts as a server. Basestation 22 (or similar) agent can connect to the visualization application running on PC 106 (FIG. 19) as a client. When the visualization application receives a connection request, it spawns a thread to process the network communications for that client. Multiple clients can connect simultaneously.

Basestation 22 can then send and receive messages via the visualization application. Some exemplary messages are discussed hereinafter.

6.2 Debugging Abilities:

The visualization application is useful for debugging basestation 22. The visualization application receives system state information and can request or send information back to basestation 22. The visualization application desirably includes a menu system from which a user can view the drivable surface or send/receive this specific information.

7 Communications Protocol:

Next, the communication protocol between various components of the system will be described with reference to a sampling of the various messages that can be used the system.

7.1 Basestation—Visualization Application Tool:

7.1.1 Message Descriptions:

CLEAR_MAP—resets the state of the visualization application and removes all road pieces, vehicles, etc.;

DISPLAY_ROAD_PIECE—commands the visualization application to display a particular type of road piece at a particular location;

CREATE_CAR—commands the visualization application to display a particular type of vehicle at a particular location;

SET_CAR_POSE—commands the visualization application to update the position and orientation of a vehicle;

DISPLAY_PATH_PLAN—commands the visualization application to display the planned path of a vehicle;

SET_STATE—changes the state of a variable in the basestation as requested by the visualization application user;

REQUEST_STATE—requests information from the basestation to be displayed by the visualization application on visual display 140.

7.2 Basestation—Agents (Vehicles, etc.):

7.2.1 Message Descriptions:

CMD_LIGHTS—22 instructs a vehicle to set its lights on, off, blinking;

CMD_LINARRAY_DATA_REQUEST—basestation 22 instructs a vehicle 2 to send data from a linear array scan by imaging system 3;

CMD_LINARRAY_DATA_RESPONSE—vehicle 2 sends the linear array scan data to basestation 22;

CMD_SCANLED—basestation 22 instructs vehicle 2 to turn its scan LED 44 on/off;

CMD_SET_EXPOSURE—basestation 22 instructs vehicle 2 to set the exposure time of the linear array of imaging system 3;

CMD_BATTERY_VOLTAGE_REQUEST—basestation 22 requests a vehicle's battery voltage;

CMD_BATTERY_VOLTAGE_RESPONSE—vehicle 22 sends its battery voltage to basestation 22;

CMD_SHIFT_LANE—basestation 22 instructs a vehicle 2 to shift to another lane;

CMD_SET_SPEED—basestation 22 instructs a vehicle 2 to achieve a certain speed;

CMD_PING_REQUEST—basestation 22 sends a vehicle 2 (or all vehicles) to respond with an "alive" (ping) notice;

CMD_PING_RESPONSE—vehicle 2 sends an "alive" (ping) response to the basestation 22;

CMD_POSE_REQUEST—basestation 22 requests the pose information from the vehicle 2 at a particular frequency;

CMD_POSE_UPDATE—vehicle 2 sends its pose information to the basestation;

CMD_BRANCH—basestation tells vehicle to follow a branch through an intersection (left, right, straight).

7.2.2 Typical Usage:

Next, a full sequence of messages that are passed between a vehicle 2 and basestation 22 during a complex driving maneuver will be described. The maneuver involves a vehicle 2 reporting its pose (where "pose" means a vehicle's position x, y and heading theta) during normal driving, changing lanes from left to right, stopping at an intersection, and then making a right turn and resuming normal driving on a new drivable section. It is important to notice that vehicle 2 doesn't actually have to send the full pose information to the basestation, but just parsed scans of marking 12 by vehicle imaging system 3, which basestation 22 uses to derive vehicle's 2 pose. This greatly reduces the need for computational power on the vehicle 2.

| Elapsed Time (seconds) | Message Direction | Message Description |
|---|---|---|
| 0 | Basestation → Vehicle | CMD_POSE_REQUEST: Normal driving (1 second updates) |
| 1 | Basestation ← Vehicle | CMD_POSE_UPDATE: send position information |
| 2 | Basestation ← Vehicle | CMD_POSE_UPDATE |
| 3 | Basestation ← Vehicle | CMD_POSE_UPDATE |
| 4 | Basestation ← Vehicle | CMD_POSE_UPDATE |
| 5 | Basestation ← Vehicle | CMD_POSE_UPDATE |
| 6 | Basestation ← Vehicle | CMD_POSE_UPDATE |
| 7 | Basestation → Vehicle | CMD_SHIFT_LANES: tell car to move to right lane |
| 8 | Basestation ← Vehicle | CMD_POSE_UPDATE |

-continued

| Elapsed Time (seconds) | Message Direction | Message Description |
|---|---|---|
| 9 | Basestation ← Vehicle | CMD_POSE_UPDATE (lane change complete) |
| 10 | Basestation ← Vehicle | CMD_POSE_UPDATE |
| 11 | Basestation ← Vehicle | CMD_POSE_UPDATE |
| 12 | Basestation → Vehicle | CMD_POSE_REQUEST: high frequency updates requested<br>CMD_SET_SPEED: tell vehicle to start stopping when certain position achieved<br>CMD_LIGHTS: set right turn signal on |
| 12.5 | Basestation ← Vehicle | CMD_POSE_UPDATE |
| 13 | Basestation ← Vehicle | CMD_POSE_UPDATE |
| 13.5 | Basestation ← Vehicle | CMD_POSE_UPDATE |
| 14 | Basestation ← Vehicle | CMD_POSE_UPDATE (vehicle stopped at this point, no further update sent until new command received) |
| 16 | Basestation → Vehicle | CMD_BRANCH: tell vehicle to take the right branch through intersection<br>CMD_SET_SPEED: tell vehicle to achieve certain speed with given acceleration after turn |
| 17 | Basestation ← Vehicle | CMD_POSE_UPDATE |
| 17.5 | Basestation ← Vehicle | CMD_POSE_UPDATE |
| 18 | Basestation ← Vehicle | CMD_POSE_UPDATE (vehicle completed turn and now on new drivable section, turns right turn signal off) |
| 18.5 | Basestation → Vehicle | CMD_POSE_REQUEST: request normal driving frequency updates (e.g., 1 second) |
| 19 | Basestation ← Vehicle | CMD_POSE_UPDATE |
| 20 | Basestation ← Vehicle | CMD_POSE_UPDATE (target speed achieved) |
| 21 | Basestation ← Vehicle | CMD_POSE_UPDATE |

7.2.3 Dealing with Uncertainty:

Although the wireless transceivers of the system will guarantee the delivery of messages, there is some uncertainly as to the delivery time of these messages. The messaging protocol does not guarantee message delivery within any specified amount of time and, as a result, there is some amount of uncertainty of the lag between when a message is sent and when it is received. Thus, both basestation 22 and the vehicles 2 must account for this uncertainty.

Fortunately, vehicle 2 is responsible for the low-level control (lane following, etc. . . . ) and basestation 22 only needs to send high-level controls to vehicle 2. This allows basestation 22 to send messages well before they need to be acted upon by vehicle 2. For example, a speed change command will instruct vehicle 2 to change speed after reaching a certain location. Vehicle 2 receives this message potentially several seconds in advance, and then takes the appropriate action when it needs to (e.g., change speed after a certain marking 12 is read by vehicle imaging system 3).

Further, basestation 22 can create path plans for vehicles 2 that account for uncertain timing in the message delivery. Vehicles 2 will maintain a safe distance behind other vehicles 2 so that they will have ample time to receive messages and act upon them.

Basestation 22 will also forward simulate the vehicle's 2 position. Since basestation 22 knows the speed of vehicle 2, it can estimate the vehicle's 2 actual position between receiving pose updates through the CMD_POSE_UPDATE message. This knowledge, along with statistics of message delivery times can be used to better estimate when messages should be sent so they can be received and acted upon in a timely manner.

8.0 Marker Obfuscation Through IR Transparent Film:

As described above, a series of markings 12 enables vehicles 2 to identify their unique positions in the drivable surface. A technique described above for encoding markings in a way not visible to humans relied upon printing the markings in an ink or dye that is not visible (transparent) to the human eye and absorbs light in the IR, NIR, or UV spectrum. By using a light source of the same light wavelength, these markings appear black to the optical sensor but are nearly or completely invisible to humans.

Alternatively, markings 12 can be printed in standard visible ink or dye, for example used in commercial inkjet printers, laser printers or professional offset or silk screen printing machines. After the markings are printed, a second layer is applied to cover those markings. This second layer includes an ink or dye or a thin plastic film that is transparent above or below human visible wavelengths, but appears opaque in the human visible spectrum. Materials having such properties are commercially available.

Figure 40:
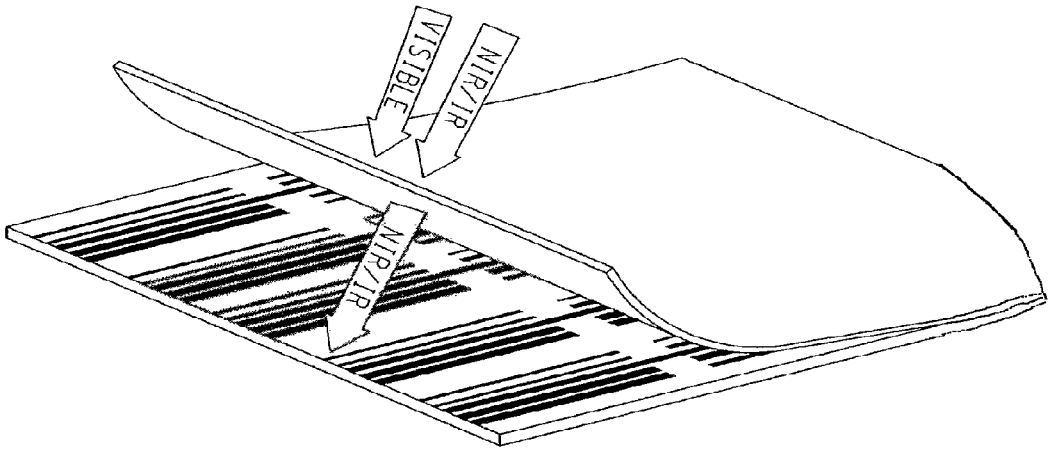
FIG. 40 is an illustration of markings printed on a road piece in standard visible ink or dye that is visible to humans covered with a material that is transparent to light with a wavelength outside the visible spectrum, whereupon an optical sensor of a vehicle with a light source matching the materials transparency wavelength can see the underlying markings while a human can only see the surface of the material since it is not transparent to visible light.
Figure 41:
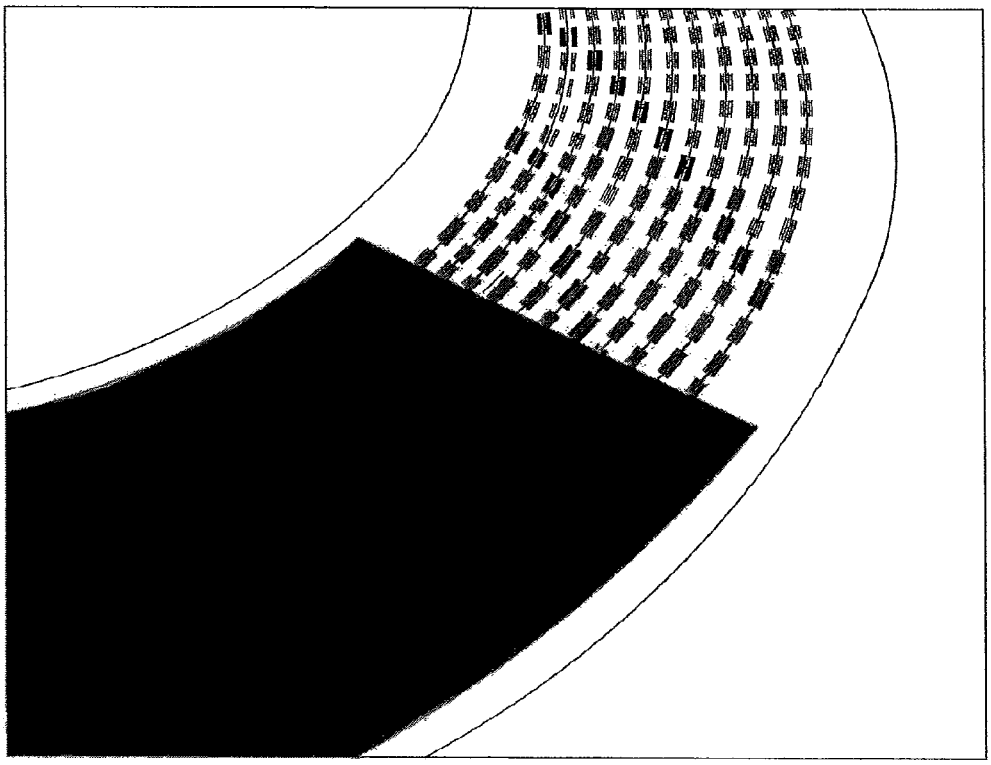
FIG. 41 is an example of a segment, wherein the bottom-left portion of the segment appears black as would be seen by the human eye and the top portion shows the markings that would be visible to NIR light that would be detectable by the imaging system of each vehicle.

For the purposes of this example, near infrared (NIR) light with wavelength of approximately 790 nm will be discussed, but the same approach can be used for any non-visible portion of the light spectrum (UV, IR, NIR, etc.). When this surface is used with a vehicle imaging system 3 with an NIR responsive imaging sensor 46 under NIR light from LED light source 44, the light will pass through the NIR-transparent material, allowing the optical sensor to detect the markings 12 underneath (most standard black ink/dye will still appear black to the optical sensor under NIR light). To the human eye, only the surface material will be visible since light in the visible spectrum will not be able to pass through. An illustration of this approach as well as the appearance to the human eye of a segment that uses this approach can be seen in FIGS. 40 and 41, respectively.

Such an approach provides an advantage in terms of ease of manufacturing and potentially low cost because codes can then be printed using standard ink or dye and standard printing techniques (ink jet, laser, offset printing machines, silk screen printing machines, etc.). Material transparent to non-visible light can then be applied using any method. Some examples include: printing, film, spray paint, stickers, decals, etc. This can also allow users to print their own drivable surfaces and then simply apply the transparent material to the surface using any of the techniques mentioned.

Figure 42:
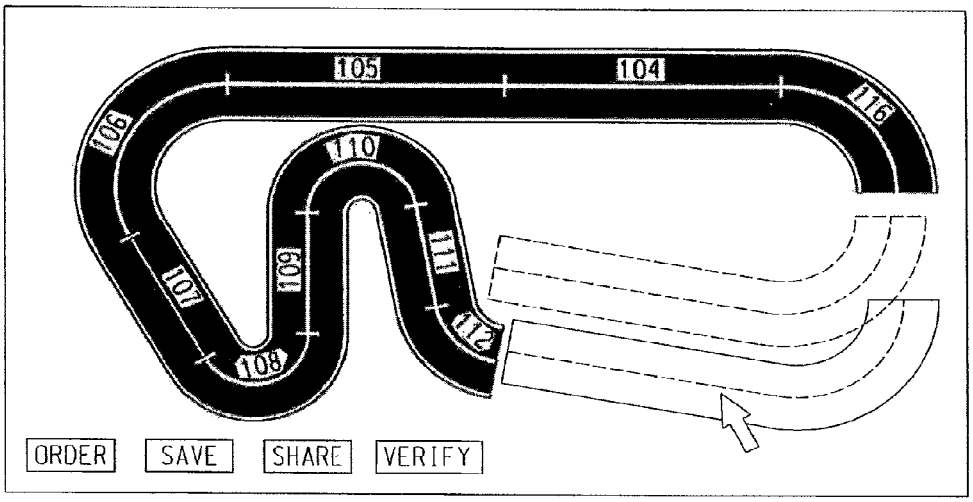
FIG. 42 is an illustration of an exemplary custom designed drivable surface for use with the system that is designed using a software application.

It is envisioned that a software application (through a PC or web-based interface) can be provided that enables a user to design a drivable surface according to their personal specifications. For example, the user can develop large-format (e.g. 12 ft×30 ft) drivable surfaces that use custom designed drivable segments. Users can specify any road piece shape they desire that includes combinations of straight segments and arcs of circles (each segment could be required to be of some minimum length) or even more complex shapes like splines etc. The software application then processes the final network shape and decomposes it into the necessary combination of segments. FIG. 42 shows an exemplary, non-limiting appearance of such an application.

Figure 43:
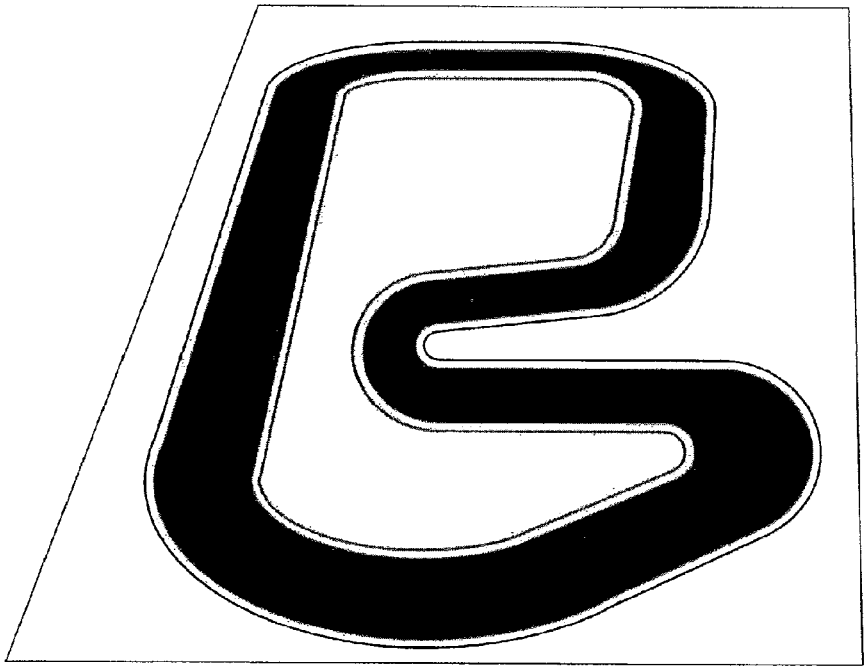
FIG. 43 is a perspective view of a custom designed drivable surface that can be designed by a user and then sent to the user after manufacturing.

This custom drivable surface can then be manufactured for the user using a flexible material, such as vinyl, that can be rolled up, transported and stored easily, taking up only a fraction of the space necessary compared to a similar drivable surface made out of rigid plastic parts. The drivable surface will appear visually the same as how the user designed it, but will also contain the position identification markings which are hidden from view using the techniques described above. FIG. 43 shows how an exemplary, non-limiting, final drivable surface sent to the user might look after manufacturing.

In addition to the final drivable surface, the user can also be provided with a file defining that particular network. The file can be transferred to the user's basestation 22 so that the basestation 22 can interact with the unique structure of that drivable surface by identifying the unique positions that each set of markings encodes and allowing vehicles 2 to generate plans accordingly.

The invention has been described with reference to exemplary embodiments. Obvious modifications and alterations will occur to others upon reading and understanding the preceding detailed description. It is intended that the invention be construed as including all such modifications and alterations insofar as they come within the scope of the appended claims or the equivalents thereof.

What is claimed is:

1. A method of controlling movement of a plurality of self-propelled mobile agents on a surface having a plurality of machine-readable codes indicating locations on the surface, wherein each self-propelled mobile agent includes a sensor configured to detect the machine-readable codes as the mobile agent travels along the surface, the method comprising, for each of the self-propelled mobile agents, performing the steps of:

(a) while traveling on the surface, the mobile agent detecting at least one of the machine-readable codes via the mobile agent's sensor;

(b) responsive to detecting the at least one machine-readable code, the mobile agent controlling its movement on the surface;

(c) the mobile agent wirelessly transmitting data regarding the detected code to a basestation for use at the basestation in determining a location of the mobile agent and updating a position of the mobile agent in a virtual representation, and for use at the basestation for determining for each mobile agent a specific action to be taken by the mobile agent based on the data regarding the detected code; and (d) the mobile agent wirelessly receiving from the basestation at least one signal to specify the specific action to be taken by the mobile agent with respect to its position on the surface in a manner whereupon the mobile agents move in a coordinated manner on the surface.

2. The method of claim 1, wherein the surface comprises a plurality of discrete segments operatively coupled together, and wherein each machine-readable code indicates at least one selected from the group consisting of:

an identifier of a segment of the surface;

an indication of a location on the segment;

an orientation of the segment; and at least one parameter of the segment.

3. The method of claim 1, wherein the machine-readable codes comprise optically readable codes.

4. The method of claim 1, wherein the machine-readable codes define at least one path of travel on the surface and encode locations on the surface.

5. The method of claim 1, wherein each mobile agent comprises a toy vehicle.

6. The method of claim 1, wherein detecting at least one of the machine-readable codes via the mobile agent's sensor comprises detecting at least one of the machine-readable codes via imaging.

7. The method of claim 1, wherein the data transmitted to the basestation is further used at the basestation for maintaining the virtual representation.

8. The method of claim 1, further including repeating steps (a)-(d) at least one time.

9. The method of claim 8, further comprising the mobile agent further controlling its movement on the surface responsive to the signal received in step (d).

10. The method of claim 9, further comprising, responsive to the signal received in step (d), the mobile agent changing from traveling on a first path defined by a first set of machine-readable codes to a second travel path defined by a second set of machine-readable codes, whereupon the signal received in step (d) specifies said second travel path.

11. The method of claim 1, further comprising the mobile agent controlling at least one of its velocity, its acceleration, its steering direction, a state of one or more of its lights, and whether an audio replication device of the vehicle outputs sound, in response to the signal received in step (d).

12. The method of claim 1, wherein the data transmitted to the basestation is further used at the basestation for determining the virtual representation of the drivable surface from at least one of the following:

a definition file accessible to the basestation;

exploration of the physical layout of the drivable surface by at least one mobile agent acting under the control of the basestation and communicating information regarding the physical layout of the surface to the basestation; and a bus system of the surface comprising a plurality of segments, wherein each segment comprises a bus segment and a microcontroller that communicates with the basestation and with the microcontroller of each adjacent connected segment via the bus segment.

13. The method of claim 1, wherein step (a) comprises detecting at least one of the machine-readable codes by acquiring an image of the machine-readable codes via an overlayer that is transparent to the mobile agent's sensor but which is opaque at human visible light wavelengths.

14. The method of claim 1, further comprising:

the basestation receiving a command for at least one of the mobile agents from a remote control; and the basestation determining the specific action to be taken by the mobile agent on the surface based on the command received from the remote control.

15. The method of claim 1, further comprising, responsive to the current location of at least one of the mobile agents on the surface and the virtual representation of the surface, causing a display to display:

a virtual image of the surface; and a virtual image of at least one mobile agent and at least one of a position and a velocity of the at least one mobile agent on the virtual image of the surface.

16. The method of claim 1, wherein determining the specific action to be taken by the mobile agent comprises determining a set of detailed steps representing a distributed command hierarchy.

17. The method of claim 1, further comprising each mobile agent determining its position on the surface based on detected machine-readable codes.

18. The method of claim 1, wherein at least one mobile agent is user-controllable, and wherein the method further comprises, at the basestation, adjusting the behavior of at least one mobile agent not under control of a user.

19. The method of claim 1, wherein the machine-readable codes encode information, the method further comprising:

at least one mobile agent interpreting at least a portion of the encoded information; and at least one mobile agent relaying at least a portion of the encoded information to the basestation for interpretation thereon.

20. The method of claim 1, wherein determining the specific action to be taken by the mobile agent comprises determining a high-level behavior for the mobile agent, and wherein the mobile agent wirelessly receiving from the basestation at least one signal to specify the specific action to be taken by the mobile agent comprises receiving a representation of the high-level behavior.

21. The method of claim 20, wherein determining a high-level behavior for the mobile agent comprises determining a high-level behavior for the mobile agent using at least one selected from the group consisting of:

an artificial intelligence algorithm;

an algorithm that incorporates randomness; and a global planning algorithm;

and wherein determining the specific action to be taken by the mobile agent further comprises determining a lower-level behavior for the mobile agent according to a local planning algorithm, based at least in part on at least one of a position and behavior of at least one other mobile agent.

22. A method of controlling movement of a plurality of self-propelled toy vehicles on a drivable surface that includes markings which define at least one path of toy vehicle travel on the drivable surface and which encode locations on the drivable surface, wherein each toy vehicle includes an imaging system for acquiring images of the markings, the method comprising, for each of the toy vehicles, performing the steps of:

(a) while traveling on the drivable surface, the toy vehicle acquiring an image of at least a portion of the markings of the drivable surface via the toy vehicle's imaging system;

(b) responsive to the image acquired in step (a), the toy vehicle controlling its movement on the drivable surface;

(c) the toy vehicle wirelessly communicating to a basestation data regarding a location where the portion of the markings in step (a) was acquired, such data for use at the basestation in determining a location of the toy vehicle and updating a position of the toy vehicle in a virtual representation of the drivable surface, and for use at the basestation in determining for each toy vehicle a specific action to be taken by the toy vehicle on the drivable surface;

(d) the toy vehicle wirelessly receiving from the basestation at least one signal to specify the specific action to be taken by the toy vehicle with respect to its position on the drivable surface in a manner whereupon the toy vehicles move in a coordinated manner on the surface.

23. The method of claim 22, further including repeating steps (a)-(d) at least one time.

24. The method of claim 23, further comprising the toy vehicle further controlling its movement on the drivable surface responsive to the signal received in step (d).

25. The method of claim 24, further comprising, responsive to the signal received in step (d), the toy vehicle changing from traveling on a first path defined by a first set of markings to a second travel path defined by a second set of markings, whereupon the signal received in step (d) specifies said second travel path.

26. The method of claim 22, further comprising the toy vehicle controlling at least one of its velocity, its acceleration, its steering direction, a state of one or more of its lights, and whether an audio replication device of the vehicle outputs sound, in response to the signal received in step (d).

27. The method of claim 22, wherein the data transmitted to the basestation is further used at the basestation for determining the virtual representation of the drivable surface from at least one of the following:

a definition file accessible to the basestation;

exploration of the physical layout of the drivable surface by at least one toy vehicle acting under the control of the basestation and communicating information regarding the physical layout of the drivable surface to the basestation; and a bus system of the drivable surface comprising a plurality of segments, wherein each segment comprises a bus segment and a microcontroller that communicates with the basestation and with the microcontroller of each adjacent connected segment via the bus segment.

28. The method of claim 22, wherein step (a) comprises acquiring the image of the markings via an overlayer that is transparent to the toy vehicle's imaging system but which is opaque at human visible light wavelengths.

29. The method of claim 22, further comprising:

the basestation receiving a command for the toy vehicle from a remote control; and the basestation determining the specific action to be taken by the toy vehicle on the drivable surface based on the command received from the remote control.

* * * * *